US007202596B2

(12) United States Patent
Tang et al.

(10) Patent No.: US 7,202,596 B2
(45) Date of Patent: Apr. 10, 2007

(54) ELECTRON EMITTER AND PROCESS OF FABRICATION

(75) Inventors: Xinhe Tang, Vienna (AT); Ernst Hammel, Vienna (AT)

(73) Assignee: Electrovac AG, Aufeldgasse (AT)

( * ) Notice: Subject to any disclaimer, the term of this patent is extended or adjusted under 35 U.S.C. 154(b) by 403 days.

(21) Appl. No.: 10/754,675

(22) Filed: Jan. 9, 2004

(65) Prior Publication Data

US 2004/0245911 A1 Dec. 9, 2004

Related U.S. Application Data

(60) Provisional application No. 60/476,431, filed on Jun. 6, 2003.

(51) Int. Cl.
*H01J 1/62* (2006.01)
*H01J 63/04* (2006.01)

(52) U.S. Cl. ..... 313/495; 313/309; 313/310; 313/336; 313/351

(58) Field of Classification Search ..... 313/495–497, 313/309–311, 336, 351; 315/169.3; 445/46, 445/51; 427/77; 73/23.2, 31.05
See application file for complete search history.

(56) References Cited

U.S. PATENT DOCUMENTS

| | | | | |
|---|---|---|---|---|
| 5,347,201 | A | 9/1994 | Liang et al. | |
| 5,773,921 | A | 6/1998 | Keesmann et al. | 313/309 |
| 5,973,444 | A | 10/1999 | Xu et al. | 313/309 |
| 6,031,328 | A | 2/2000 | Nakamoto et al. | |
| 6,087,765 | A | 7/2000 | Coll et al. | 313/309 |
| 6,100,628 | A | 8/2000 | Coll et al. | 313/310 |
| 6,232,706 | B1 | 5/2001 | Dai et al. | 313/309 |
| 6,277,318 | B1 | 8/2001 | Bower et al. | 264/346 |
| 6,312,303 | B1 | 11/2001 | Yaniv et al. | 445/24 |
| 6,350,388 | B1 | 2/2002 | Knappenberger et al. | 216/42 |
| 6,380,671 | B1 | 4/2002 | Lee | |
| 6,417,606 | B1 | 7/2002 | Nakamoto et al. | 313/336 |
| 6,426,590 | B1 | 7/2002 | Chung et al. | |
| 6,440,761 | B1 | 8/2002 | Choi | 438/20 |
| 6,445,125 | B1 | 9/2002 | Na et al. | 313/497 |
| 6,464,890 | B2 | 10/2002 | Knappenberger et al. | 216/42 |

(Continued)

FOREIGN PATENT DOCUMENTS

EP 1 176 234 A2 2/2002

(Continued)

OTHER PUBLICATIONS

ASTM Standard Designation: D 3359-02, pp. 1-7 (2002).

(Continued)

*Primary Examiner*—Nimeshkumar D. Patel
*Assistant Examiner*—Kevin Quarterman
(74) *Attorney, Agent, or Firm*—Christopher Paradies; Fowler White Boggs Banker P.A.

(57) ABSTRACT

An electron emitter is formed by in situ growth from the vapor on catalyst clusters that are adhered by an adhesion layer to a conductive electrode. The emitter comprises hemispheroidal nanofiber clusters that emit electrons at low field strengths and high current densities, producing bright light by the interaction of the electrons and a fluorescent and/or phosphorescent film on an anode spaced across an evacuated gap. The nanofibers may be grown such that the nanofiber clusters are entangled, restricting movement of individual nanofibers.

56 Claims, 18 Drawing Sheets

U.S. PATENT DOCUMENTS

| | | | | |
|---|---|---|---|---|
| 2001/0024633 | A1 | 9/2001 | Lee et al. | |
| 2001/0050537 | A1 | 12/2001 | Itoh et al. | |
| 2002/0076846 | A1 | 6/2002 | Ihm | 438/34 |
| 2002/0084502 | A1 | 7/2002 | Jang et al. | 257/432 |
| 2002/0160111 | A1 | 10/2002 | Sun et al. | 427/248.1 |
| 2002/0182970 | A1 | 12/2002 | Liu et al. | 445/51 |
| 2002/0197928 | A1 | 12/2002 | Ahn et al. | 445/59 |
| 2003/0025851 | A1 | 2/2003 | Cheng et al. | |
| 2003/0090190 | A1 | 5/2003 | Takai | 313/311 |
| 2003/0122771 | A1 | 7/2003 | Sumiyoshi et al. | |
| 2004/0104668 | A1* | 6/2004 | Lee et al. | 313/496 |

FOREIGN PATENT DOCUMENTS

| | | | |
|---|---|---|---|
| WO | WO-00/30141 | A1 | 5/2000 |
| WO | WO-02/081366 | A | 10/2002 |
| WO | 03-025966 | A | 3/2003 |
| WO | WO-03/026796 | A2 | 4/2003 |

OTHER PUBLICATIONS

Definition of "feedstock", U.S. Environmental Protecion Agency, Terminology Reference System, http://www.epa.gov/trs, 1 page, downloaded Aug. 18, 2003.

Definition of "oblate spheroid," http://mathworld.wolfram.com, 9 pages, downloaded Mar. 12, 2003.

Definition of "prolate spheroid," http://mathworld.wolfram.com, 3 pages, downloaded Mar. 12, 2003.

Starch Soluble, MSDS No. S6505, 6 pages, downloaded from http://www.jtbaker.com on Jul. 3, 2003.

X.D. Bai et al., "Synthesis and field-emission behavior of highly oriented boron carbonitride nanofibers," Applied Physics Letters 76(18):2624-2626 (2000), abstract downloaded from http://content.aip.org on Aug. 12, 2003.

J. Chen et al., "Field emission from crystalline copper sulphide nanowire arrays," Applied Physics Letters 80(19):3620-3622, 2002, abstract downloaded from http://content.aip.org on Aug. 12, 2003.

Y. Chen et al., "Field emission of different oriented carbon nanotubes," Applied Physics Letters 76(17):2469-2471 (2000), abstract downloaded from http://content.aip.org on Aug. 12, 2003.

K.A. Dean, "The environmental stability of field emission from single-walled carbon nanotubes," Applied Physics Letters 75(19):3017-3019 (1999), abstract downloaded from http://content.aip.org. on Aug. 12, 2003.

K.A. Dean et al., "Current saturation mechanisms in carbon nanotube field emitters," Applied Physics Letters, 76(3):375-377 (2000), abstract downloaded from http://content.aip.org on Aug. 12, 2003.

L. Dong et al., "ZnO nanowires formed on tungsten substrates and their electron field emission properties," Applied Physics Letters 82(7):1096-1098 (2003), abstract downloaded from http://content.aip.org on Aug. 12, 2003.

Y-H. Lee et al., "Tungsten nanowires and their field electron emission properties," Applied Physics Letters 81(4):745-747, abstract downloaded from http://content.aip.org on Aug. 12, 2003.

S.C. Lim et al., "Saturation of emission current from carbon nanotube field emission array," AIP Conference Proceedings 590(1):221-224 (2001), abstract downloaded from http://content.aip.org on Aug. 12, 2003.

Z. Pan et al., "Oriented Silicon Carbide Nanowires: Synthesis and Field Emission Properties," Adv. Materl. 12(16):1186-1190 (2000).

W. Shi et al., "Laser Ablation Synthesis and Optical Characterization of Silicon Carbide Nanowires," J. Am. Ceram. Soc. 83(12):3228-3330 (2000).

M. Sveningsson et al., "Field Emission from Multiwalled Carbon Nanotubes," AIP Conference Proceedings 633(1):548-551 (2002), abstract downloaded from http://content.aip.org on Aug. 12, 2003.

K.W. Wong et al., Field-emission characteristics of SiC nanowires prepared by chemical-vapor deposition, Applied Physics Letters 75(19):2918-2920, abstract downloaded from http;//content.aip.org on Aug. 12, 2003.

C.Y. Zhi et al., "Enhanced field emission from carbon nanotubes by hydrogen plasma treatment," Applied Physics Letter 81(9):1690-1692, abstract downloaded from http://content.aip.org on Aug. 12, 2003.

Y.W. Zhu, "Efficient field emission from ZnO nanoneedle arrays," Applied Physics Letters 83(1):144-146 (2003), abstract downloaded from http://content.aip.org on Aug. 12, 2003.

Gröning, O, et al: "Field emission properties of carbon nanotubes" Journal of Vacuum Science & Technology B: Microelectronics Processing and Phenomena, American Vacuum Society, New York, NY, US, vol. 18, No. 2, Mar. 2000, pp. 665-678.

Patent Abstracts of Japan, vol. 2003, No. 9, Sep. 3, 2003 & JP 2003 131224 A, May 8, 2003. (Abstract Only) (US Equivalent is being submitted herewith as US 2003/122771).

"Cathodoluminescent Backlight For Liquid Crystal Displays", Research Disclosure, Mason Publications, Hampshire, GB No. 321, Jan. 1991, p. 74.

* cited by examiner

ELECTRON EMITTER AND PROCESS OF FABRICATION

RELATED APPLICATION

This application claims the benefit of U.S. Provisional Application No. 60/476,431, filed Jun. 6, 2003, which is incorporated in its entirety by reference herein.

FIELD OF THE INVENTION

The emission of charged particles from a conductor in the presence of an electric field is known as field emission. Convention describes an electron as emitted across a gap from a cathode to an anode. Typically, field emission display (FED) electron emission in a vacuum uses micro-sized tips. The micro-sized tips emit electrons by a strong electric field from a cathode to an anode causing a fluorescent and/or phosphorescent material to emit light. Such FED devices may provide both excellent brightness and resolution at low power, as well as exceptional thinness and light weight. Specifically, the field of the invention relates to nanofiber electron emitters for use in field emission devices.

BACKGROUND OF THE INVENTION

The term "nanofiber" summarizes a large family of different "one-dimensional" nanostructures, such as nanowires, nanotubes and other filamentous structures having outer diameters in the nanoscale. Carbon nanofibers are used for reinforcement applications, as electrically conductive fillers, as catalyst support, in nanoelectronic devices, as artificial muscles and as a storage medium for gas or electrical chemical storage. However, different morphologies of carbon nanofibers are preferred for different applications.

Other materials are known that can be synthesized via chemical vapor deposition as nanofibers, which may be suitable for use as nanofiber electron emitters for use in field emissive displays. For example, these materials include metal nanowires, such as bismuth, tungsten and silver, metal oxide nanofibers, such as ZnO, metal sulfide nanofibers, such as $Cu_2S$ and $MoS_2$ and other compounds that form nanofiber morphologies, such as gallium nitride, boron nitride, boron carbide nitride, silicon and silicon carbide. In one example, SiC nanofibers may be synthesized by a reaction between carbon nanofibers and silica, and the SiC nanofibers adopt the same morphology as the carbon nanofiber clusters. For example, SiC synthesis is described in "Oriented Silicon Carbide Nanowires: Synthesis and Field Emission Properties," by Zhengwei Pan et al., Adv. Mater. 2000, 12, No. 16, Aug. 16, 2000, which is incorporated herein by reference in its entirety.

Various methods are used to grow nanofibers, which is used herein to include within its definition nanowires, single-walled nanotubes, multi-walled nanotubes and other nanofiber morphologies. Each of these methods results in characteristically different nanofiber morphologies and nanofiber chemistry, which greatly affects the emission characteristics of the nanofibers. For example, plasma deposition of carbon to form carbon nanotips produces an irregular structure of carbon nanotips extending from a layer of graphitic carbon. See U.S. Patent Application Publication No. US 2002-0084502 A1. It is believed that this process would be difficult to scale up to produce large display devices and would result in instabilities in electron emission of the resulting film. In U.S. Pat. No. 6,100,628, a partially graphitized nanocrystalline material was formed by cathodic arc vapor deposition. The plasma characteristics were responsible for producing the partially graphitized nanocrystalline carbon structures, having a plurality of larger particles embedded within a plurality of smaller particles. However, adherence of the particles was poor, unless the surface was first subjected to carbon ion bombardment at −1,000 volts, thereby creating a porous layer.

In another process, pre-formed carbon nanotubes were sprayed onto a surface and selectively attached to a substrate. A portion of the nanotubes adhered to the surface in a pattern. Then, the remaining carbon nanotubes were removed from the surface of the substrate where no adhesion was made between the nanotubes and the surface. The adhesion strength of the resulting pattern nanotubes was sufficient to exceed the 2a or 2b scale in the ASTM Tape Test No. D3359-97, which is now superseded by ASTM Test No. D3359-02. However, the thickness of the patterned nanotube film was generally 0.1 to 1 micrometer with the ends of the carbon nanotubes being oriented in random directions and free to move under the influence of an applied voltage. Thus, it is believed that such films have inherent instabilities that preclude high current densities and high gap voltages that are desirable for acceptable display brightness.

During field emission, an electron extracted and accelerated by an electric field collides, for example, with a phosphor on the screen, and light is emitted. Local instabilities within the phosphor screen are caused by movement of carbon nanotubes having free ends under an imposed voltage difference across the emission gap. The charged tips of carbon nanofibers are attracted by electrostatic forces toward the anode, changing the gap distance. A reduced gap distance increases the apparent field strength causing localized instabilities, which can damage a field emission display.

Carbon nanofibers may be grown by chemical vapor deposition (CVD). However, carbon nanotubes grown by conventional CVD on a substrate fail to show effective adhesiveness. See U.S. Patent Application Publication No. US 2002-0084502 A1, published Jul. 4, 2002, at column 1, paragraph [0006]. Reportedly, the carbon nanotube films also fail to provide uniformity and stability in electron emission applications. Also, it is generally believed that alignment of nanotubes is necessary to achieve good stability and emission characteristics, but alignment increases process complexity and cost.

There exists a longstanding and unfulfilled need for a low cost, highly stable carbon nanofiber emitter for field emission applications.

SUMMARY OF THE INVENTION

An electron emitter comprises a conductive electrode and isolated clusters of carbon nanofibers grown in situ by chemical vapor deposition on an electrode. The nanofiber clusters emit electrons at low voltages and at high current densities, and adhere to the electrode. The electron emitter is supported by a substrate and is operably connected by a wiring pattern to a voltage source. The electron emitter is useful as the cathode of a field emission device. Preferably, the nanofibers within a nanofiber cluster are grown such that they are entangled, preventing individual nanofibers from moving across the gap between the cathode and anode of a field emission device.

The conductive electrode is joined to the substrate in a conventional manner, such as bonding or adhering a layer of metal to an insulating substrate, using sputtering, for example. The layer of metal may be conventionally patterned and etched to form a pattern of pixels and a wiring pattern, for example. Then, a catalytic precursor is deposited on the conductive electrode. The precursor comprises a catalyst for growing carbon nanofibers by chemical vapor deposition, a solvent and aggregated non-catalytic particles. For example, the catalytic precursor is applied to the pixels as a paste or slurry. The composition of the catalytic precursor is selected such that isolated carbon nanofiber clusters are formed during nanofiber growth, and an adhesion layer is capable of being formed between the electrode and the nanofiber clusters during preparation of the nanofibers, such as during a step of drying, heating and/or reducing the catalyst precursor and/or during growth of the nanofibers. For example, the adhesion layer forms by a chemical reaction between the electrode and the compounds formed from the precursors during processing of the cathode.

One object of the invention is to form nanofiber clusters that adhere to the substrate even at high voltage and high current density. Another object of the invention is to inexpensively produce carbon nanofiber clusters that have excellent electron emission characteristics, for example, a current density versus field strength that exhibits a high current density at a low threshold field strength. Yet another object is to reduce fabrication costs for commercial production of field emission devices compared to conventional devices.

Other features and advantages of the present invention will become apparent from the following description of the invention, which refers to the accompanying drawings.

DETAILED DESCRIPTION OF PREFERRED EMBODIMENT

An electron emitter comprises a conductive electrode and fibrous clusters formed by in situ catalytic growth of nanofibers from a catalyst precursor. The precursor comprises, in one embodiment, a mixture of catalyst, non-catalytic particulates, a binder and a solvent. Preferably, the catalyst is selected to grow graphitic carbon nanofibers. Alternatively, nanofibers may be made of other emissive materials by conventional chemical vapor deposition processes using the process for preparing and activating clustered catalyst particulates as disclosed herein. The precursor is deposited on the conductive electrode, for example, by spraying, printing and other physical or chemical deposition procedures. The precursor may be deposited in a pattern and/or patterned after deposition using conventional processes such as masking or photolithography.

For example, nanofibers may be single-walled nanotubes or multi-walled nanotubes or non-tubular nanowires or a mixture of these and other fibrous morphologies. Preferably, at least a portion of fibrous graphitic carbon is in the form of multi-walled carbon nanotubes. More preferably, at least half of the nanofibers are multi-walled nanotubes. Multi-walled carbon nanotubes have excellent emissive properties and inherently long service stability. Single-walled carbon nanotubes also have good emissive properties, such as a low threshold field strength for electron emission (e.g. less than 0.2 volts per micrometer), but the growth conditions for single-walled nanotubes are more difficult to achieve for large area displays. Also, single-walled carbon nanotubes typically have shorter useful lifetimes than multi-walled carbon nanotubes.

Figure 11:
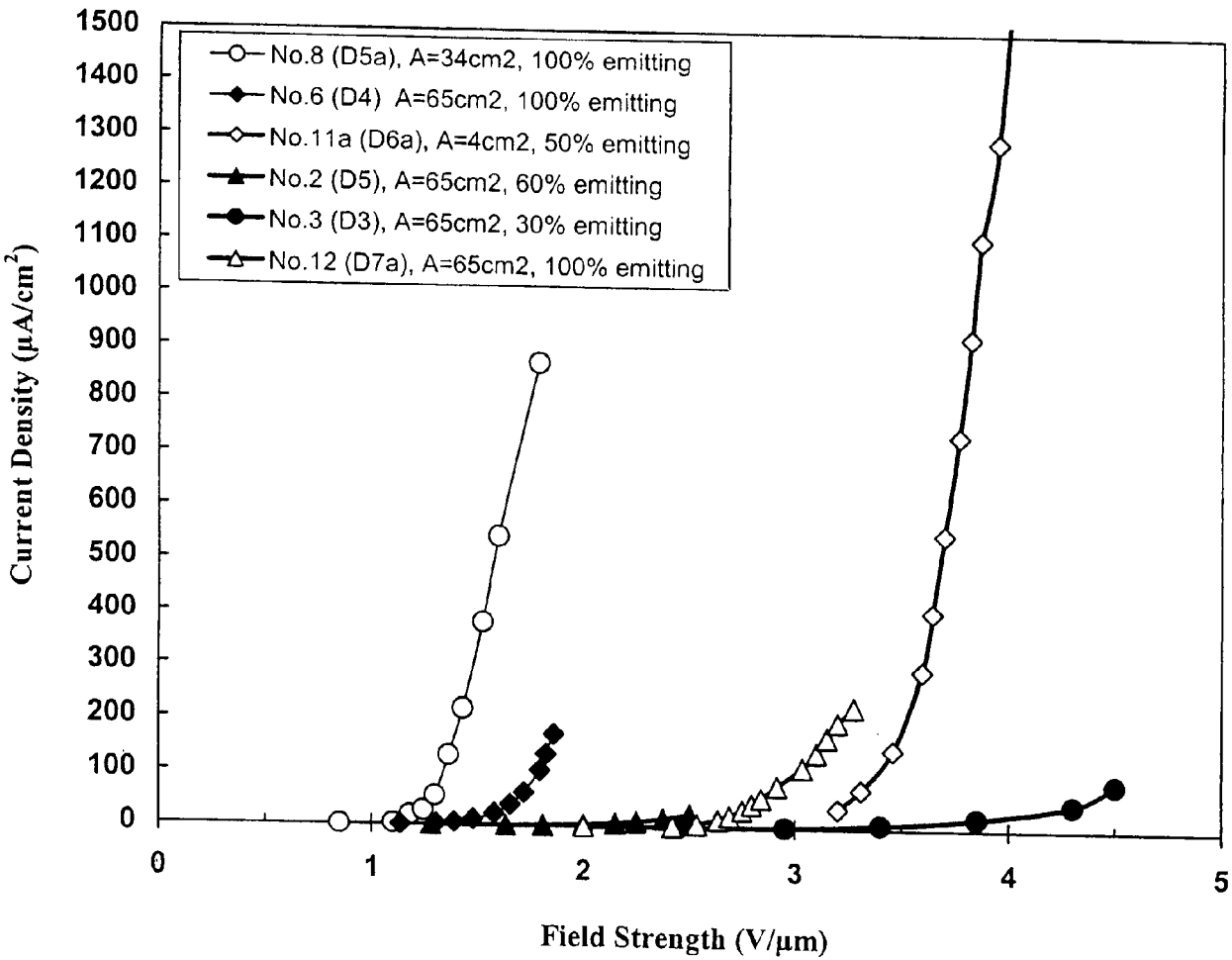
FIG. 11 shows a graph showing the current density versus field strength for several embodiments.

A diode comprising an anode having a luminescent material, a conductive cathode and an electron emissive film having a plurality of isolated clusters of carbon nanofibers was tested and had a pixel current density versus field strength as shown in FIG. 11. The field strength threshold is less than two (2) volts per micrometer (V/μm), as depicted in example 8, for example. The field strength threshold is preferably from 1 V/μm to 3.5 V/μm. Preferably, the maximum current density of the as-grown nanofibers, after assembly in a field emission diode exceeds 900 $\mu A/cm^2$. More preferably, the maximum current density exceeds 2.7 $mA/cm^2$. It is known that posttreatment of the nanofibers by processes such as ultraviolet exposure, plasma, laser ablation and/or ion bombardment improves emission characteristics compared to as-grown nanotubes.

In one embodiment, the conductive electrode and wiring pattern is a metal, such as aluminum, chromium, gold, platinum and other metals and alloys thereof. Nickel, iron and cobalt are not included in the conductive electrode and wiring pattern at levels sufficient to act as a catalyst for carbon nanofiber growth. Preferably, the electrode is aluminum, and the aluminum forms an adhesion layer with the catalyst clusters.

Adhesion between the substrate and the conductive wiring pattern is achieved by any conventional means. For example, a thin layer of aluminum, e.g. 0.1 μm, is formed by sputtering an aluminum on a substrate, such as an insulating substrate or a semiconductor substrate. In one specific embodiment, the substrate is a glass. Then, a wiring pattern and pixels are formed using photolithography and/or a wet chemical etch of the aluminum layer. For example, the wiring pattern may include electrodes in the shape of single pixels connected by wired traces capable of being connected to electronic logic circuitry.

Then, a catalyst precursor is deposited on the surface of the electrodes. For example, catalyst clusters are deposited by spraying, printing, stamping or any other feasible physical or chemical deposition method. Patterning may be achieved by lithography. More preferably, the pattern is complete as deposited, reducing the number of processing steps.

In one embodiment, printing of the catalyst clusters is achieved by one of screen printing, soft printing and micro-contact printing. For example, the process of precursor deposition leaves isolated catalyst clusters dispersed across the surface of each of the electrodes. This process may be used for both large surface areas and fine pixel dimensions. The cathode may cover a large area, providing a uniform light emitting surface. The ease of deposition of the catalyst precursor on the conductive substrate allows large electron emitting areas to be fabricated inexpensively.

In one embodiment, the precursor clusters are physically moved or removed during an inspection step prior to catalytic growth of nanofiber clusters. By physically moving or removing certain non-uniform clusters, a uniformly sized and evenly distributed arrangement of clusters is achieved. Preferably, a deposition process is used that disperses uniformly sized and evenly distributed precursor clusters over a large surface without the need for subsequent movement or removal of precursor clusters before catalytic growth of nanofiber clusters. By evenly dispersing and uniformly sizing the fibrous clusters, the resulting light intensity of a pixel in a field emission device appears even and uniform to the human eye. In one such embodiment, an inspection step after deposition is used to reject substrates not having both the uniform size and even distribution of precursor clusters prior to further processing. Then, the rejected substrates are easily cleaned and reused in a subsequent deposition process after process parameters are modified, for example, by servicing the equipment used for the deposition process. Thus, an inexpensive automated process is capable of producing electron emitters for use in comparatively inexpensive and large-scale displays. Herein, the term "large-scale displays" refers to displays of about a 30-inch diagonal or larger.

The cylindrical diameter of carbon nanofibers relates directly to the size of the active catalyst particulates used in catalytic growth of the carbon nanofibers, e.g. iron/nickel particulates in agglomerated clusters. Therefore, decreasing the size of the catalyst particulates results in a finer cylindrical diameter of the carbon nanofibers grown from the catalyst particulates. It is believed, without being limiting in any way, that reducing the cylindrical diameter of the carbon nanofibers leads to a direct reduction in the threshold field strength at which electrons are emitted from the cathode to the anode. All else being equal, it is preferable to have a low field strength threshold; therefore, smaller catalyst particulates are more desirable than larger catalyst particulates, if the rate of catalytic growth, useful lifetime of the screen and adherence to the conductive electrode during operation otherwise remain within acceptable limits.

In one embodiment, the average size of a catalyst particulate is at least 30 nm. Preferably, the average size is limited to a range no greater than 150 nm. Such particulates have been shown to grow carbon nanofibers in one embodiment of the invention that have a mean outer diameter of at least about 50 nm. "About" is used here to indicate that the measurement of nanofiber diameters include both systematic and random errors. Preferably, the mean outer diameter of carbon nanofibers is no greater than about 200 nm, which corresponds to a maximum catalyst particulate size of 150 nm, for example.

The average size and uniformity of the size of catalyst particulates is determined by the processing steps used to precipitate the catalyst particulates from solution, as well as the type of catalyst precursors selected, for example metal nitrates, sulfates and chlorides. One preferred process is co-precipitation of solutions containing soluble metal nitrates, for example an iron nitrate and a nickel nitrate, on non-catalytic particulate clusters. Other catalytic and non-catalytic materials may be added to the solution to control the size and activity of the catalyst precipitates.

Precipitation of metal compounds is initiated, for example, by adding a precipitating agent or by evaporation of the solvent. The resulting catalyst clusters are dried, and the metal precipitates are calcined to convert the precipitates to metal oxides or mixed metal oxides. The calcined metal oxides are then reduced at an effective temperature in a reducing atmosphere, e.g. hydrogen, for an effective time to produce the desired metal particulates.

Preferably, the process selected produces an adhesion layer between the catalyst clusters and the conductive electrode simultaneously with the precipitation and activation of the catalyst particulates. Then, carbon nanofibers are grown by catalytic growth from the catalyst during exposure to a reactive atmosphere at a reaction temperature. In one embodiment, the adhesion layer develops or further develops during the catalytic growth of the carbon nanofiber clusters. The adhesion layer prevents degradation of the field effect device during operation by binding the carbon nanofiber clusters to the conductive electrode. This improves the effective lifetime and reduces the rejection rate of electron emitters for use in field effect devices.

In one embodiment, the catalyst precursor is prepared in the form of a paste before being printed. The paste comprises a catalyst for growth of carbon nanofibers, non-catalyzing particles, a binder for binding the catalyst and the non-catalyzing particles into catalyst clusters and a solvent. Any catalyst for growing nanofibers in a chemical vapor deposition process may be used, such as particles based on the elements nickel, iron and cobalt in the case of carbon nanofibers. Preferably, the catalyst is based on nickel, iron or mixtures of nickel and iron. More preferably, the catalyst is prepared using a mixture of nickel nitrate and iron nitrate dissolved in a solvent that is subsequently precipitated onto non-catalyzing particle clusters or particles. For example, the catalyst precipitates are supported by starch particles. The resulting agglomeration of catalyst particulates on the surface of a non-catalytic particle has a range of particulate sizes. The range in size of catalyst particulates is less than the size of the starch particles or other such non-catalyzing particles as may be used. Preferably, the size is no greater than 5 μm, although larger sizes may be acceptable or even desired in some applications. Indeed, the size of an agglomeration of catalyst particulates is usually less than size of the non-catalyzing particles, and the size of individual catalyst particulates is some fraction of the size of the agglomeration of catalyst particulates. As the size, shape and density of the catalyst particulates ultimately influences the size of the nanofibers, the precipitation process is preferably controlled to yield catalyst particulates of a uniform size, shape and density on the non-catalyzing particles ultimately providing uniform nanofiber clusters during the process of catalytic growth.

The binder may be any binder compatible with the catalyst, the non-catalyzing particles and the solvent. For example, the binder may be of cellulose, polyvinyl alcohol and/or a photoresist, such as PMMA. The binder is preferably a cellulose, such as ethyl cellulose, which forms a film on the non-catalyzing particles. Alternatively, the non-catalyzing particles may agglomerate catalyst particulates on the surfaces of the non-catalyzing particles without using any binder. Additionally, the solvent may dissolve all or a portion of the binder and all or a portion of the catalytic compounds. In the case of only partial dissolution, the remaining catalytic compounds may act as seeds for nucleation of precipitates. In a preferred embodiment, all of the binder and catalytic compounds are dissolved by the solvent, and the catalytic particulates readily precipitate from solution during drying while the binder forms a film on the surface of the non-catalyzing particles.

The solvent dilutes the paste. The amount of solvent may be selected to help control the density of catalyst clusters and the viscosity of the catalyst precursor for the deposition such that the catalyst clusters are dispersed on the surface of the electrodes. The amount and type of solvent also influences the precipitation process. Thus, preferably, the amount and type of solvent should be selected such that a uniform size and even distribution of catalyst clusters results ultimately providing evenly distributed and uniformly sized nanofiber clusters. For example, in alternative embodiments, the solvent is terpineol, an alcohol or a combination of terpineol and alcohol. The solvent may include additional modifiers, such as higher alcohols, oils and other chemical additives that are known to modify the properties of the solvent as desired.

For example, the non-catalyzing particles may be of organic material, inorganic material or a combination of organic and inorganic materials, such as a starch, a polymer, a metal, an oxide, such as alumina, titania or silica, combinations of these particles and/or these particles coated by an organic film. A starch may be a purified starch or an impure and/or raw starch. An organic film can be selected to interact with the metal precipitates binding the metal precipitates to the non-catalyzing particles. In one embodiment, the surfaces of the non-catalyzing particles are swellable by the solvent, aiding the binding of the catalyst particles on the non-catalyzing particles.

Preferably, the composition of the catalyst paste is selected to create an adhesion layer between the electrode and the catalyst clusters. In one example, starch particles are used having a mean maximum lineal dimension, e.g. the mean of the largest distance between any two points on the surface of a particle averaged over a statistically significant representative sample of such particles, in a range from about 5 μm to about 30 μm. More preferably, the mean maximum lineal dimension is uniformly sized in a range from 5 to 10 μm, having a standard deviation of less than 3 μm, preferably about 2 μm. Purified starch has a chemical formula of $(C_6H_{10}O_5)_n$. The starch particles do not fully dissolve in the solvents, and an even distribution of uniformly-sized starch particles in the catalyst precursor is preferred. Agglomeration of the non-catalytic particles may be prevented by selection of the material of the particles and the solvent. For example, uniformly-sized mung bean starch shows an even distribution within a solvent of terpineol and within a mixture of ethyl cellulose, terpineol, an alcohol and catalyst compounds. Also, agitation, chemical additives, such as dispersants, and other known process may be used to control agglomeration and de-agglomeration. Precipitating catalyst particulates adhere to the particles, forming catalyst clusters after appropriate processing, such as drying, annealing in an oxidizing atmosphere and reduction of the residuals. For example, corn starch, potato starch, rice starch, wheat starch and bean starch may be used as non-catalytic particles. Preferably, mung bean starch is used to prepare hemispheroidal catalyst clusters.

After depositing the catalyst precursor on an electrode, a pre-treatment step is included to dry the catalyst paste on the surface of the electrode. Then, in a step of thermal pretreatment volatile compounds and most of the other organic compounds of the paste are driven off at a temperature from 350° C. to 550° C. in an oxidizing atmosphere, such as air, oxygen or $CO_2$. The thermal pretreatment temperature may exceed 550° C., but should not exceed a temperature at which the substrate or the conductive wiring pattern is damaged. Heating the catalyst precursor in an oxidizing atmosphere volatilizes at least a portion of the binder, non-catalyzing particles and solvent, and forms catalyst oxides. Also, chemical changes, such as diffusion, alloying and chemical reactions, between or among the electrode, the catalyst and/or the non-catalyzing particles and/or binder creates an adhesion layer between the electrode and the catalyst clusters. The non-catalyzing particles, if organic, are pyrolized during this step.

Then, the catalyst oxide is reduced to form catalytic nanoparticles within the catalyst clusters. A chemical vapor deposition (CVD) process forms carbon nanofibers from the catalytic nanoparticles. Any CVD process may be used that produces nanofibers, including solid fibers and tubes that exhibit good electron emission. In a preferred embodiment, the CVD process is carried out at about 550° C. in a gas flow reactor using a stream of gas as a feedstock, the feedstock comprising 10 vol % acetylene, 45 vol % hydrogen and 45 vol % argon. Here, "about" is used to indicate a processing range having a temperature at least 500° C. and no greater than 600° C. Preferably, the temperature range is controlled to within 10° C. of 550° C. The growth of the carbon nanofibers is completed in less than ten minutes. The resulting nanofiber clusters are excellent emitters. Preferably, the carbon nanofiber clusters are isolated, uniformly sized and evenly dispersed across the surface of the electrode or electrodes. It is desirable to have a uniform distribution of cluster size and height and an even distribution of clusters within the electrode area such that the resulting light intensity across the electrode is even and uniform to the human eye. Isolated means that the clusters are physically distinguishable on the surface of the electrode and are not screened by the nanofibers of neighboring clusters.

For example, the fibrous clusters have entangled, hemispheroidal shapes, such as prolate hemispheroids or oblate hemispheroids. The composition of the precursor suspension and method of deposition determines the spacing between the catalyst clusters on an electrode. The suspension may be thinned by adding additional solvent to reduce the density of catalyst clusters, for example. In one embodiment, the catalyst precipitation forms a layer, or partial layer, on the non-catalyzing particles. By increasing the amount of catalyst compound in solution with the solvent, more catalyzing particulates are created and a greater amount of surface area of the non-catalyzing particles is coated with the catalyst. Thus, the density and size of nanofibers is controlled by the amount and density of non-catalyzing particles and the amount of catalyst in solution.

Figure 1A:
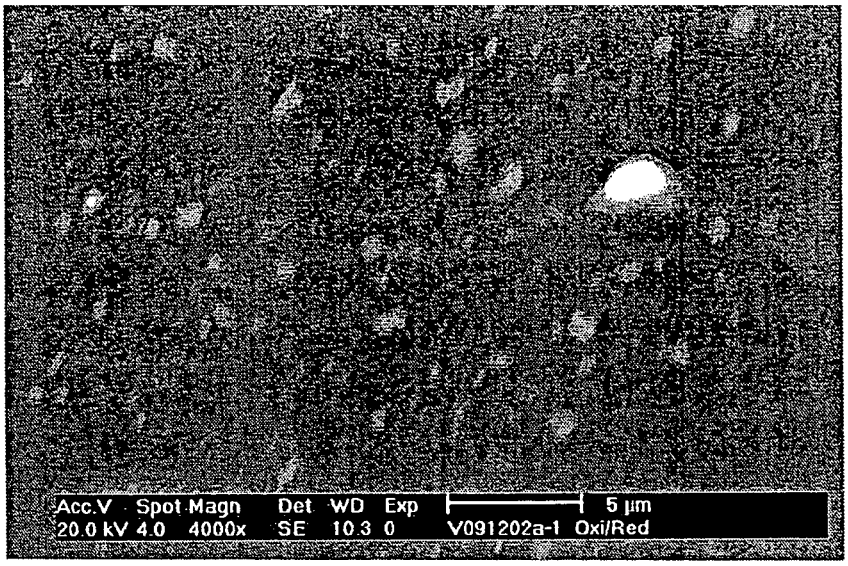
FIGS. 1A and 1B show a pretreated cathode, according to the present invention before (1A) and after (1B) CVD growth.
Figure 1B:
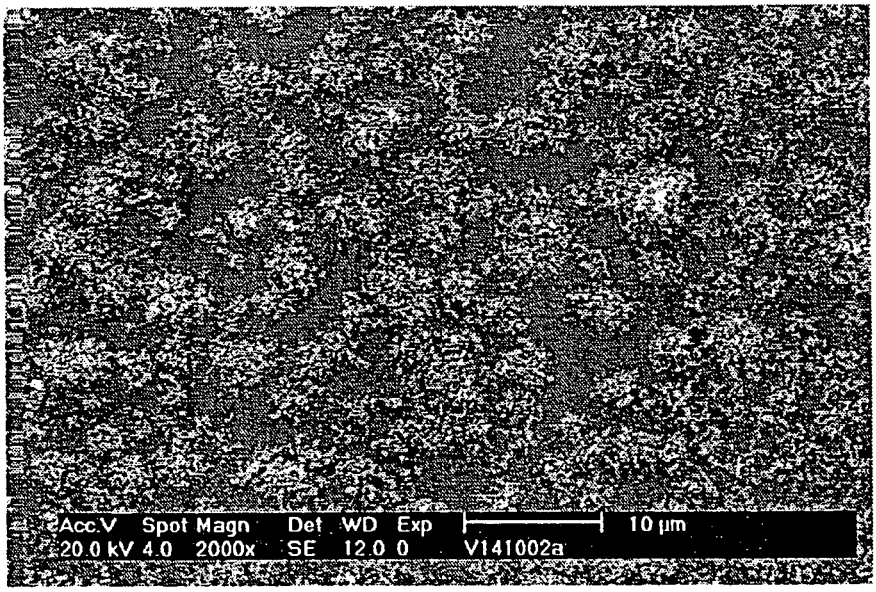

In one embodiment, catalyst clusters comprise non-catalytic organic particles and a cellulose binder, such as ethylcellulose, with a catalyst precipitated on the surface of the organic particles. For example, the particles are suspended in a solvent of terpineol, or terpineol and ethanol, forming a catalyst paste. The catalyst paste is printed onto the surface of a conductive electrode and dried, forming a dispersion of catalyst clusters, as shown in FIG. 1A. A pretreatment causes the catalyst clusters to adhere to the surface of the electrode by an adhesion layer. It is believed that the adhesion layer is formed by intermetallic bonds between the electrodes and catalysts or non-catalytic metals and/or by carbides such as metal carbides formed from the pyrolized non-catalytic organic particulates and or binder. For example, a starch may be used as organic, non-catalyzing particles, which leads to a tenacious adhesion layer between the catalyst clusters and the conductive electrode after pretreatment.

Figure 2A:
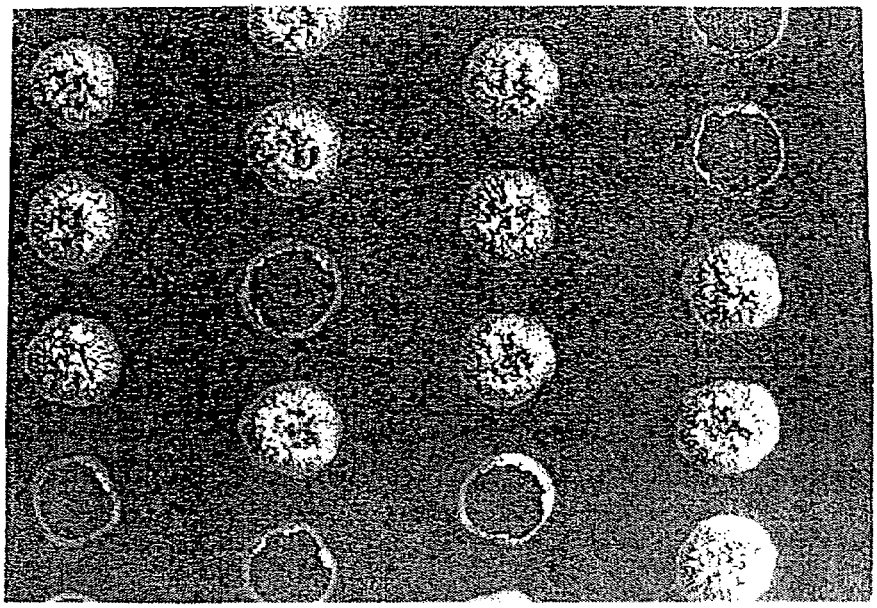
FIG. 2A shows an example of carbon nanofibers with poor adhesion with missing pixels after exposure to a stream of compressed air.
Figure 2B:
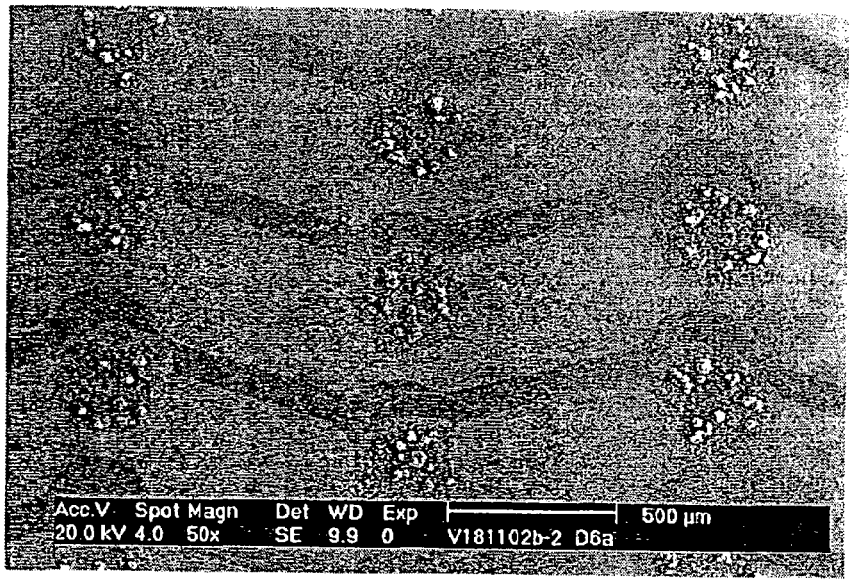
FIG. 2B shows one embodiment of the invention having excellent adhesion.
Figure 3:
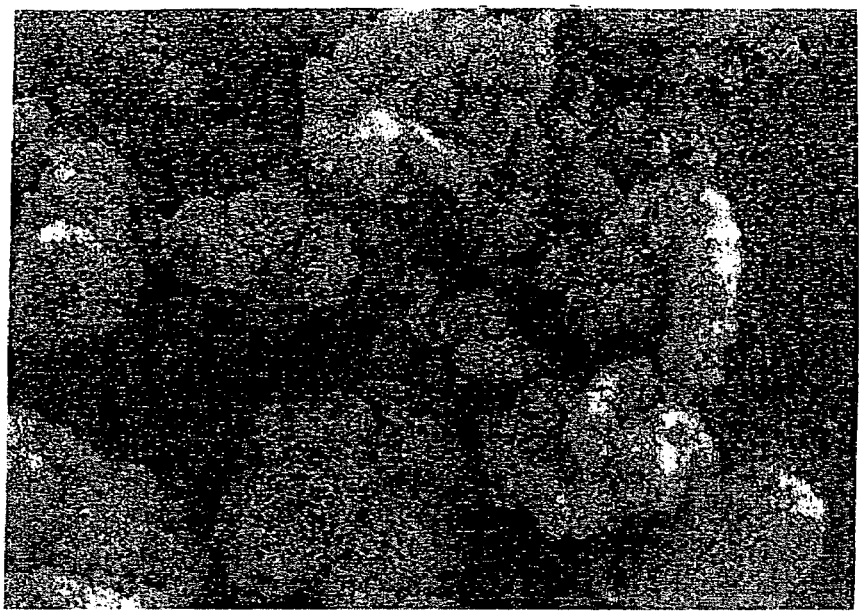
FIG. 3 shows an embodiment having an inhomogeneous growth of carbon nonofibers.

Intermetallics and metal carbides are observed in electrode grain boundaries that have strong adhesion layers. It is believed that diffusion and alloying phenomena occurring between the catalyst clusters at the grain boundaries on the face of the electrode surface establish good adhesion of the nanofiber emitters to the cathode. FIG. 2A shows that poor adhesion of nanofibers to an aluminum film occurs, when the nanofibers are grown by a method that does not produce an adhesion layer. In one example, the carbon was totally removed during the step of oxidation, reducing or eliminating carbides from the adhesion layer. For example, starch and ethyl cellulose can decompose in an oxidizing atmosphere forming carbon dioxide and water, if oxidation is complete. Otherwise, carbon residue remains after pretreatment, which is available to form carbides, such as metal carbides. Specifically, compressed air from a laboratory compressed air line removes many of the carbon nanofiber clusters from the cathode without an adhesion layer, as shown in FIG. 2A. In contrast, compressed air had no effect on the embodiment of the invention shown in FIG. 2B, which used starch particles and an ethyl cellulose binder to form catalyst clusters having an adhesion layer joining the catalyst clusters to the aluminum film. The difference between adhesion of FIGS. 2A and 2B is primarily attributed to the formation of carbides from residue of the starch particles at the grain boundaries in the metal film of the electrode. The carbon nanofiber clusters of FIG. 2B show excellent adhesion with none of the pixels being removed when subjected to the same use of forced air as the anode shown in FIG. 2A.

For example, a conductive substrate may be a metal film on a non-conductive or semiconductive base. Preferably, the metal film is selected to form an adhesion layer with the catalyst and/or non-catalytic particles. Thus, after growth of the carbon nanofiber clusters, for example by catalytic chemical vapor deposition (CVD), the nanofiber clusters are then adhered to the metal film by the adhesion layer. The adhesion layer formed during the pretreatment tenaciously holds the pixels made of carbon nanofiber clusters to a metal film, such as an aluminum film, after CVD of the nanofibers.

Figure 4:
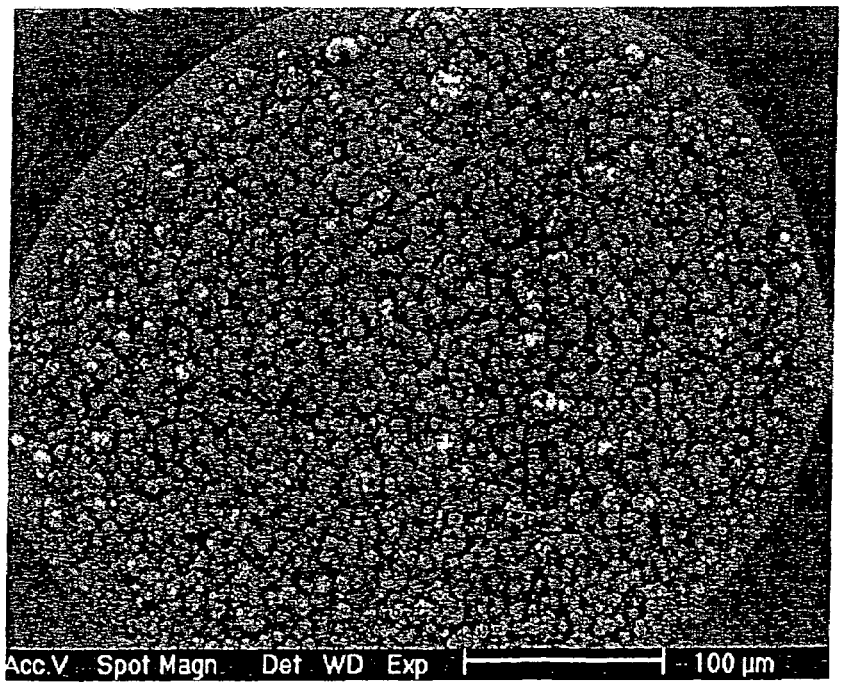
FIG. 4 shows a pixel of one embodiment having good adhesion and isolated carbon nanofiber clusters.
Figure 5:
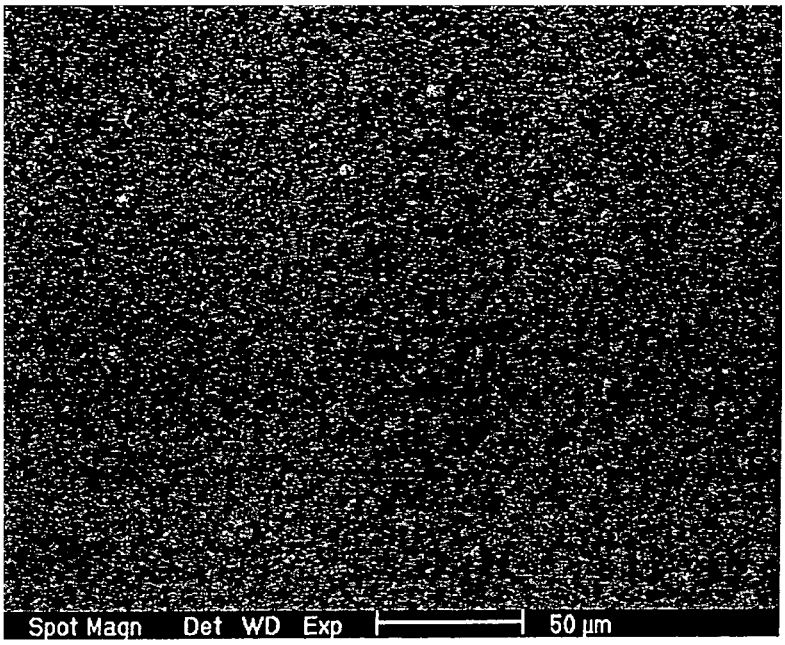
FIG. 5 shows the same magnification as FIG. 3 but with regular, homogeneous carbon nanofiber clusters of the embodiment shown in FIG. 4.
Figure 6:
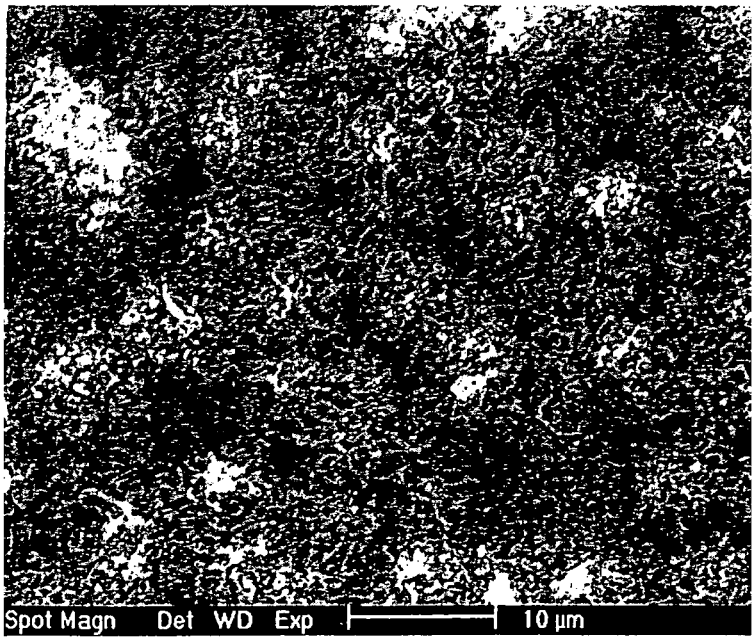
FIG. 6 shows a close-up view of FIG. 4, showing the individual nanofibers making up clusters.
Figure 7:
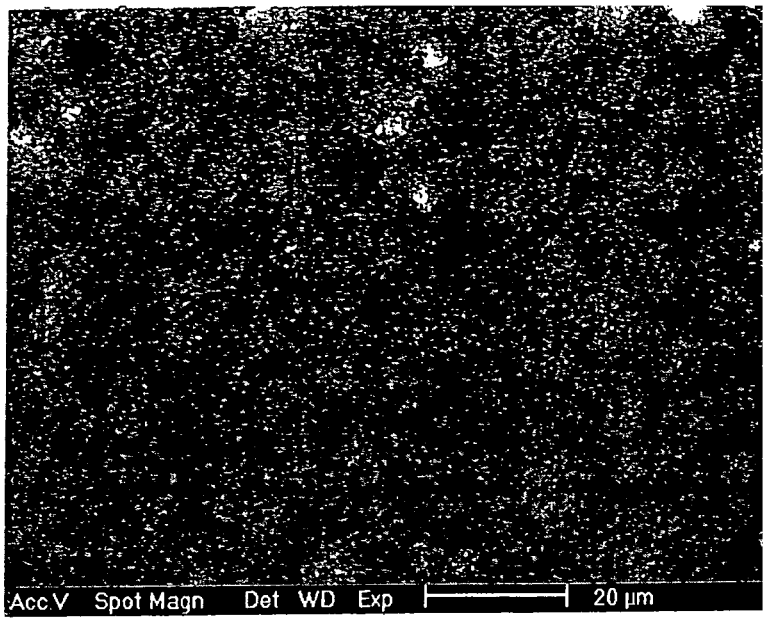
FIG. 7 shows another embodiment having isolated clusters.
Figure 8:
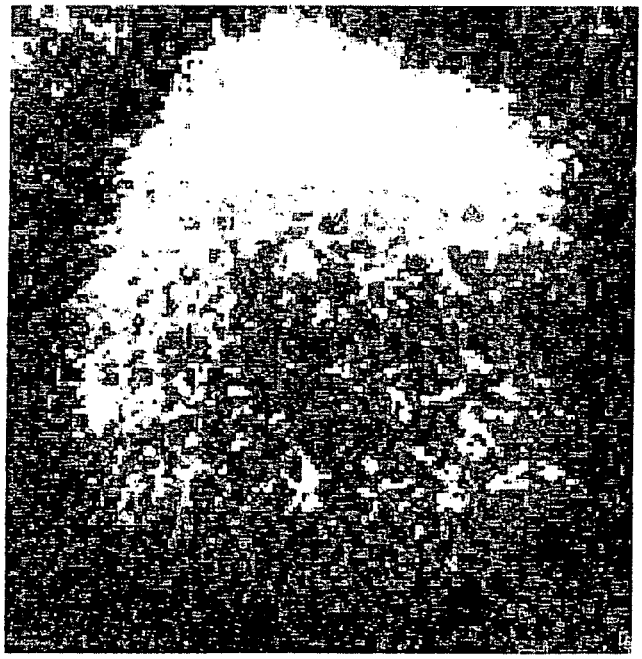
FIG. 8 shows an example of one isolated cluster having a shape similar to a prolate hemispheroid.
Figure 9A:
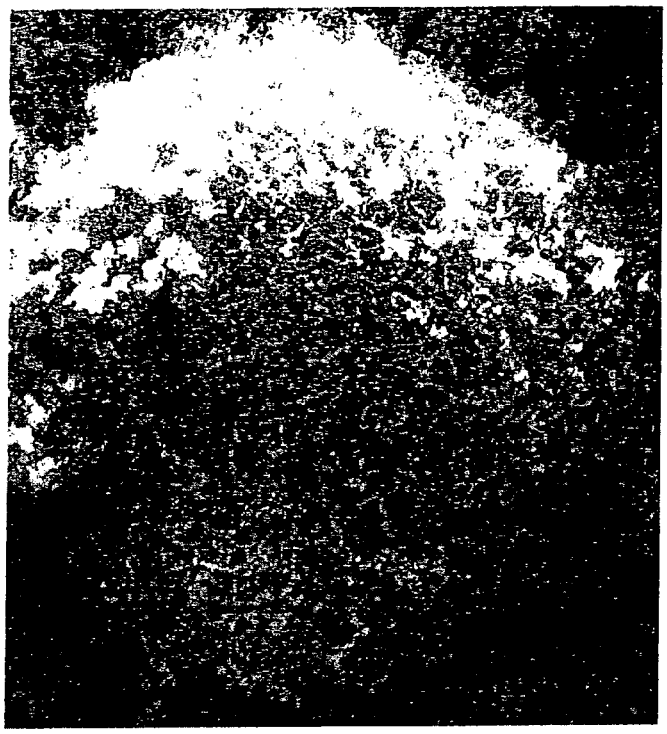
FIG. 9A shows a cluster having the shape of an oblate hemispheroid.
Figure 9B:
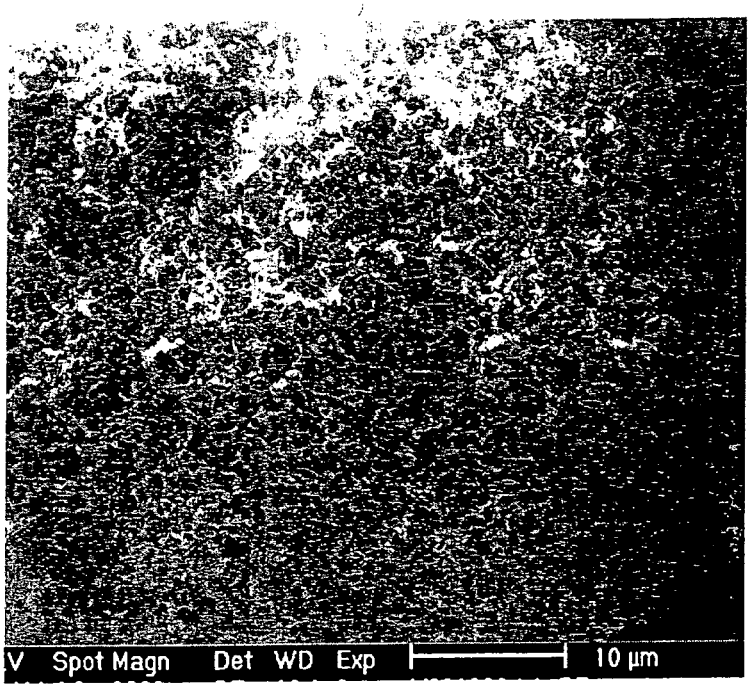
FIG. 9B shows a close-up of the oblate hemispheroid cluster showing individual carbon nanofibers.

Emitters comprising carbon nanofiber clusters that used starch particles as the non-catalyzing particles showed excellent adhesion, were uniformly dispersed across the surface, had good uniformity in size and height and a good density per unit surface area of the electrode. For example, FIG. 4 shows an entire pixel of one embodiment. FIG. 5 is a further magnified view of the embodiment shown in FIG. 4, and FIG. 6 is even further magnified such that the individual carbon nanofibers that form the nanofiber clusters may be seen more clearly. Another embodiment having isolated carbon nanofiber clusters is shown in FIG. 7.

Furthermore, starch having desirable dimensions is readily available and comparatively inexpensive, such as mung bean starch, corn starch, potato starch, and the like. Upon fabricating a field effect diode, the pixel current density is high, and a field strength threshold of less than 2 V/μm is achieved, as shown in FIG. 11. A large current density with comparatively low voltage makes the electron emitting surface energy efficient, as well.

In a preferred embodiment, ethyl cellulose is used as a binder and thickener in combination with terpineol, a solvent and thinner, to prepare a printable paste. Alternatively, a combination of terpineol and ethanol are used as the solvent. Preferably, 5–18 wt. % of ethyl cellulose is added to terpineol to form a printable paste. Other combinations of binders and solvents may replace ethyl cellulose and terpineol; however, a binder and solvent combination should be tailored for dissolving the catalyst precursors, such as nickel and/or iron compounds, and dispersing an organic and/or inorganic non-catalytic particulate within a slurry or paste capable of being deposited on a surface of a conductive substrate. Alternatively, nanoscale nickel and iron catalyst particulates may be suspended in a slurry or paste that is tailored to bind the nanoscale catalyst particles to larger non-catalytic particles and/or non-catalytic particulate clusters.

In one embodiment, nickel (II) nitrate hexahydrate, $Ni(NO_3)_2\ 6(H_2O)$ and/or iron (III) nitrate nonahydrate, $Fe(NO_3)_3\ 9(H_2O)$ are dissolved in ethanol. Enough ethanol to completely dissolve the nickel and iron catalyst compounds is preferred. Preferably, the ethanol is pure, having less than 0.1% water. In one embodiment, particulates of a starch are added to the catalyst solution before the catalyst solution is mixed with a paste of terpineol and a cellulose. Alternatively, starch is added to an alcohol, preferably ethanol, and then mixed with the catalyst solution. In another alternative, the catalyst solution is first mixed with the terpineol/ethyl cellulose paste and then the starch is added to the combined catalyst paste. In another embodiment, after particulates of a starch are precipitated with catalysts in a catalyst solution and are filtered, they are mixed with the paste of binder and solvent. In yet another alternative, the metal nitrates and the starch particulates form a paste in a solvent, and then the combined paste is mixed to the terpineol and ethyl cellulose paste. In a further alternative, the metal nitrates, water and starch form a solution firstly, and then the solution is dried by means of, for example, heating or spraying, forming a secondary particulate pregnated with catalyst, and finally the secondary particulates are mixed with a binder-solvent paste.

The particulates of starch are non-catalytic and serve as a surface for the precipitation of the catalyst during processing. By non-catalytic, it is meant that the purpose of the starch is not to catalyze the growth of nanofibers. Preferably, the particulates form catalyst clusters. The catalyst clusters form, for example, by the addition of the starch particles before the catalyst paste is deposited on the surface of the conductive substrate. In a preferred embodiment, ethyl cellulose binds precipitating iron/nickel catalyst compounds to the starch particulates, which form particulate clusters of non-catalyzing particles decorated with iron/nickel catalyst precipitates. The individual precipitate size can be selected to have an average cross-sectional area and distribution of cross-sectional areas that grow nanofibers of a particular average cylindrical diameter and distribution.

The length of the nanofibers is controlled by the CVD process, which can be terminated when a desired length is reached. The mixture of hydrogen in the CVD atmosphere is used to keep the catalyzing precipitates active for nanofiber growth, for example. The gaseous mixture and temperature may be selected to grow single-walled nanotubes or multiwalled nanotubes or other non-tubular nanofibers, for example. Preferably, the nanofibers are "clean" meaning that the surfaces of nanofibers have insignificant amounts of carbon particles and/or the like. In one embodiment, clean nanofibers are grown that comprise hemispheroidal fibrous clusters having a mean major axis dimension no greater than 1000 times the mean outer cylindrical diameter of the nanofibers, preferably in a range from 50 to 100 times the mean outer cylindrical diameter.

In one embodiment, "clean" carbon nanofiber clusters are further processed. For example, it is known that carbon nanofibers can be converted to nanofibers of other materials, such as a silicon carbide, a titanium carbide, a niobium carbide, an iron carbide, a boron carbide. In one specific embodiment, carbon nanofiber clusters are grown, and then further processing steps react the carbon nanofibers with silica by vaporizing silica in a stream of inert gas, such as argon, to form SiC nanofiber clusters having a morphology similar to the carbon nanofiber clusters. Substrates and electrodes supporting silicon carbide nanotubes may be selected that are capable of surviving processing conditions, such as processing temperatures of up to 1400° C. High melting point metals, intermetallics and conductive composites are suitable as electrodes, and substrate materials that are stable at the processing temperatures are well known.

It is thought, without being limiting in any way, that nanofiber clusters may be grown that are self-gating, such that the morphologies of the nanofibers and clusters themselves induce efficient field emission characteristics. In addition, a gate can be included that helps to induce field emission from the clusters by conventional means.

EXAMPLES

The following embodiments are presented merely as specific examples, and the scope of the claims are not to be limited thereto. In the following examples, various processing parameters are adjusted to show the effect of the processing parameters on the capability of being printed, the adhesion of the nanofiber clusters and the I-V characteristics of a field effect device fabricated with the resulting electron emitter.

In each example, unless expressly specified otherwise, a paste or slurry is made comprising at least a catalyst solution having a catalyst-nitrate compound or catalyst salt capable of dissolving in ethanol and an ethanol solvent, such as nickel hexahydrate for nickel and iron nonahydrate for iron; an ethyl cellulose binder; and a terpineol solvent for resolving the binder and for thinning the paste or slurry. The metal catalyst ions are dispersible. Some of the examples further comprise starch particulates, which are either added to the catalyst solution before mixing the catalyst solution with the ethyl cellulose/terpineol paste or added to the ethyl cellulose/terpineol paste after the catalyst solution is added to the ethyl cellulose/terpineol paste.

Many variations in parameters are possible during the chemical vapor deposition of the nanofibers and during fabrication of the field emission device. However, the deposition process of the catalyst precursors, the chemical vapor deposition process and the method of fabrication of the field emission device was kept constant in several examples, allowing a direct comparison of the different catalyst precursors.

The catalyst precursor deposition process comprised screen printing of the catalyst paste or slurry on a clean aluminum electrode surface. Then, the terpineol and/or any remaining ethanol solvents are evaporated during a drying step. Next, a thermal pretreating step first oxidizes the metal catalyst or catalysts in air and then reduces the metal oxides in hydrogen.

Specifically, the thermal pretreating step comprises heating the substrate, aluminum electrode and catalyst precursor to a temperature greater than 500° C. in air. The temperature is maintained between 500° C. and 550° C., which is less than the softening temperature of the glass substrate used in these examples. The heating is continued for a duration sufficient to vaporize any remaining solvent, burn off substantial amounts of the starch particulates and the ethyl cellulose binder and oxidize the catalyst precursor to oxide. It is believed, without being limiting in any way, that chemical changes and diffusion during this heating step commences formation of an adhesion layer between the precursor clusters and the aluminum layer. Next, the step of reducing the oxides uses the same temperature range of 500–550° C., but replaces the oxidizing atmosphere with hydrogen, which reduces the oxide, activating catalytic, metal nanoparticulate clusters.

Next, carbon nanofibers are grown from the nanoparticulate clusters by catalytic chemical vapor deposition at 550° C. in a flow of gas comprising 10 vol % acetylene, 45 vol % hydrogen and 45 vol % argon in a tubular reactor within an annular furnace. The growth of carbon nanofibers is monitored and terminated within a few minutes, when sufficient nanofiber growth has occurred to form nanofiber clusters, as shown in FIGS. 1–9. The comparatively short time required for catalytic growth using this specific process is advantageous, because the process throughput is greater than some other methods, reducing the cost of fabrication and increasing the commercial competitiveness of the ultimate field emission device. Meanwhile, formation of carbon black can be greatly reduced. In the specific process described here, the carbon nanofibers form clusters of multi-walled carbon nanotubes and non-tubular nanofibers. In some examples, the clusters are firmly adhered to the aluminum electrode by an adhesion layer.

Figure 16A:
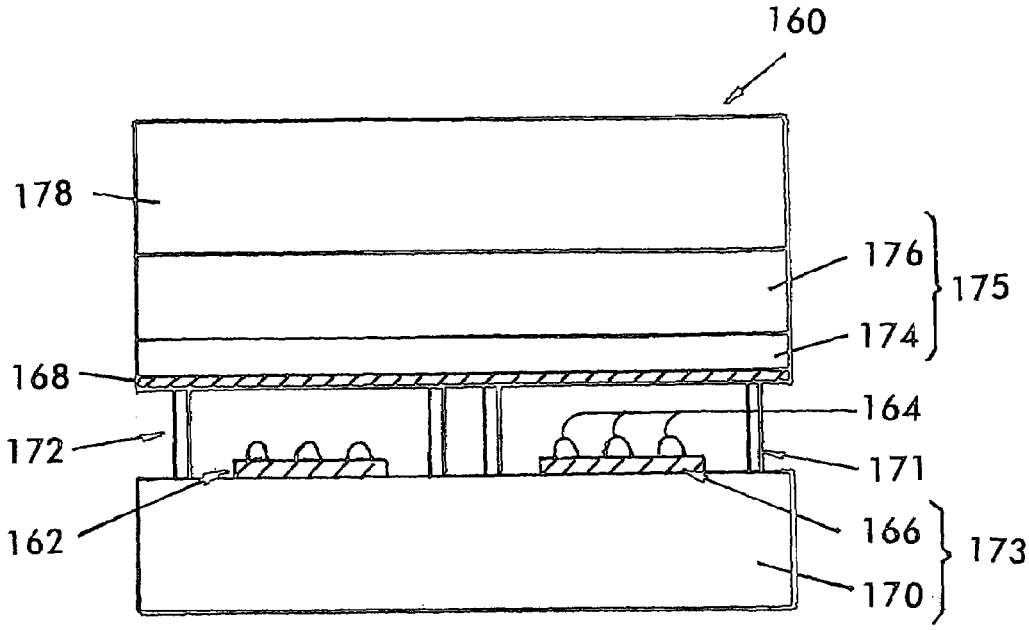
FIG. 16A shows a field emission device, as one example of an embodiment of the present invention.
Figure 16B:
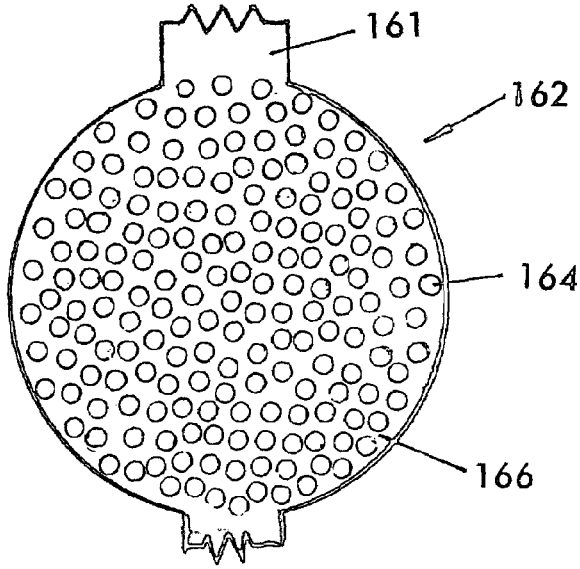
FIG. 16B shows one electrode of the device of FIG. 16A.

For example, a sketch of a field emission device is presented in FIGS. 16A and 16B. The electron emitter 162 comprises an electrode 166 and a plurality of nanofiber clusters 164. For example, the nanofiber clusters 164 are graphitic carbon nanofibers, silicon carbide nanofibers or other electron emitting nanofibers, such as metal nanowires, metal oxide nanofibers, metal sulfide nanofibers and other nanofibers made of compounds such as gallium nitride, boron nitride, boron carbide nitride, silicon and silicon carbide. Electron emitters 162 are adhered to a substrate 170, forming the cathode side of the field emission device 160. A spacing frame 172 separates the cathode side 173 from the anode side 175. The anode side 175 of the field emission device 160 comprises a thin metallic layer 168, a phosphorescent or fluorescent layer or layers 174, a conductive electrode 176 and a transparent substrate 178. The electrode 176 may be a transparent layer, such as Indium tin oxide or another transparent conductive material and the electrode 176 may be patterned to correspond to the pattern of electron emitters 162. The frame 172 separating the cathode side 173 from the anode side 175 comprises at least one framing element 171 that is capable of sealing the space between the cathode side 173 and the anode side 175, such that the space between the cathode 173 and the anode side 175 may be evacuated. Each of the electrodes 166 may be connected in an electronic circuit (not shown) by wire traces 161, a portion of which is shown in FIG. 16B.

As an alternative, the housing 178, 175, 172, 171, 173, as shown in FIG. 16A, may be configured to allow at least a portion of the volatile compounds and gases external to the housing to enter the housing at a controlled rate, as is well known in the prior art, such that the electron emitter 162 is capable of detecting volatile compounds and gases external to the housing, as a sensor. The electron emission characteristics between the anode and the emitter is used to detect the presence or absence of one or more volatile compounds or gases entering the space between the anode 175 and cathode 173.

Example 1

A catalyst paste comprises nickel, ethyl cellulose binder, terpineol and alcohol. Specifically, from 5 to 18 wt % of ethyl cellulose was resolved in 100 milliliters of terpineol, and from 0.01 to 1 wt % of nickel was added to the mixture to form a paste. Then, from 1 to 10 vol % of alcohol, e.g. ethanol, was added to the paste. Excellent printing characteristics were observed during screen printing of the catalyst paste. An area of 65 square centimeters was covered with the catalyst paste and at least 30% to 60% of the area was observed as emitting light after processing and incorporation of the cathode into a field effect light emitting device. The characteristic I-V curve had a field strength threshold and current limits similar to that for Example 3.

Example 2

Figure 10:
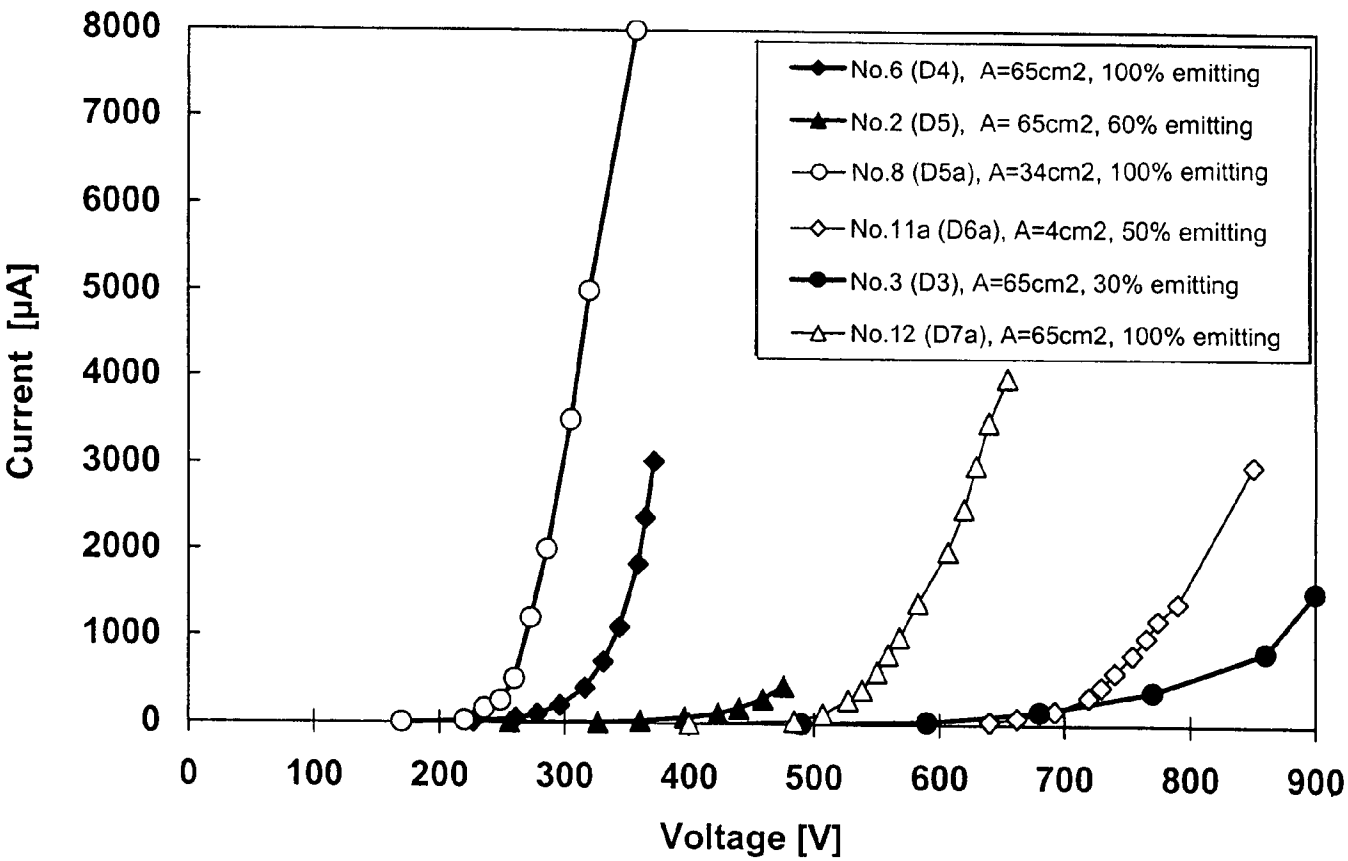
FIG. 10 shows a graph of the current versus voltage for several examples.

A catalyst paste (D5) was made by mixing 10 wt % ethyl cellulose with 100 milliliters of terpineol. Then, 0.1 wt % of nickel and 0.1 wt % of iron were dissolved in an amount of alcohol equal to 10 vol. % of the ethyl cellulose and terpineol paste. The catalyst solution was then added to the paste and mixed at a temperature of 60° C. forming an homogeneous printable catalyst paste. After printing the paste on an aluminum film, pretreating thermally in air and hydrogen, and processing the paste to form carbon nanofibers by chemical vapor deprivation, a light emitting field emission diode was produced. About 60% of the surface area of the diode was light emitting, and the I-V characteristics of the resulting device are shown in FIG. 10.

Example 3

A catalyst paste (D3) was prepared using a nickel nitrate dissolved in alcohol mixed in a paste of 10 wt % ethyl cellulose in 100 milliliters of terpineol. The 5 vol % solution of alcohol and nickel nitrate was added and mixed at a temperature of 60° C. The paste was printed on an aluminum film, pretreated thermally in air and hydrogen and processed by chemical vapor deposition to form 100 nm average diameter and 5–10 μm length carbon nanofibers. Then, a field emission diode was fabricated using the carbon nanofibers as the cathode, and at least 30 to 60% of the anodic, phosphorescent area was light emitting.

Example 4

In this example, the ethyl cellulose/terpineol was replaced by PVA/water. Satisfactory screen printing was not achieved, and no device was fabricated.

Example 5

In this example, terpineol was replaced by ethanol only. Satisfactory screen printing was not achieved, and no device was fabricated.

Example 6

A catalyst paste (D4) comprised 10 wt % ethyl cellulose binder and 0.06 wt % of nickel and 0.06 wt % of iron. Nickel nitrate and iron nitrate dissolved in ethanol. 6 vol % of the catalyst solution was added to the ethyl cellulose and terpineol paste and mixed at 60° C. It is believed that at least a portion of the ethanol vaporized during mixing. This paste was printed on the surface of an aluminum electrode on glass substrate and used to fabricate a field emission diode. The entire anode area (65 $cm^2$) was light emitting, and the I-V characteristics are shown in FIG. 10. The improved synergistic results are attributed to the combination of nickel and iron catalysts in the paste. The formation of nickel/iron catalyst clusters is preferable to either nickel or iron alone.

Example 7

In this example, water replaced ethyl cellulose/terpineol. Satisfactory screen printing was not achieved, and no device was fabricated.

Example 8

Figure 12A:
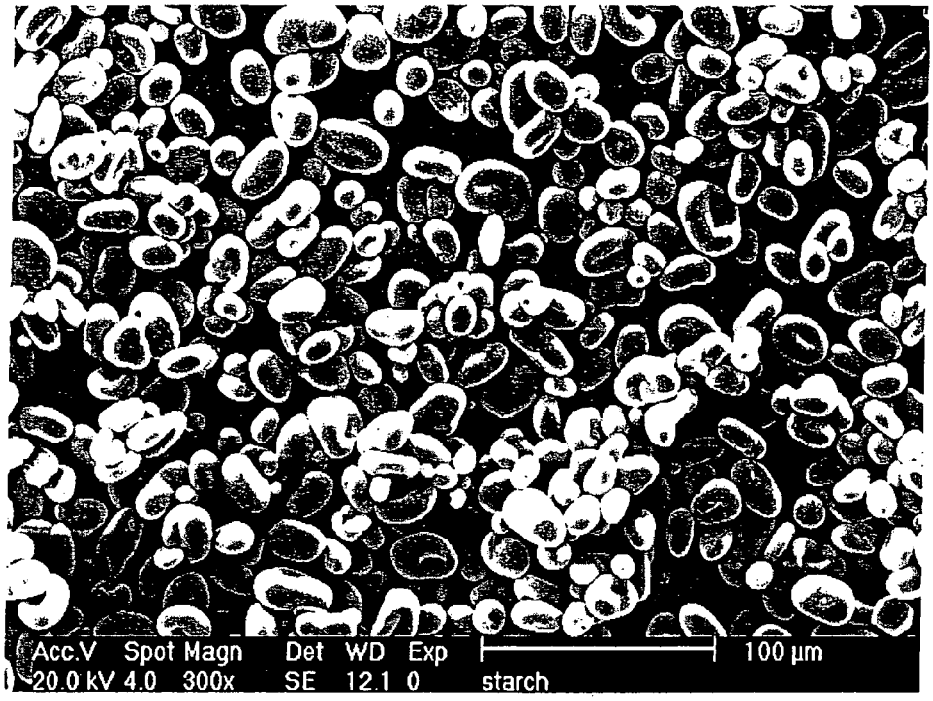
FIGS. 12A and 12B show magnified images of mung bean starch.
Figure 12B:
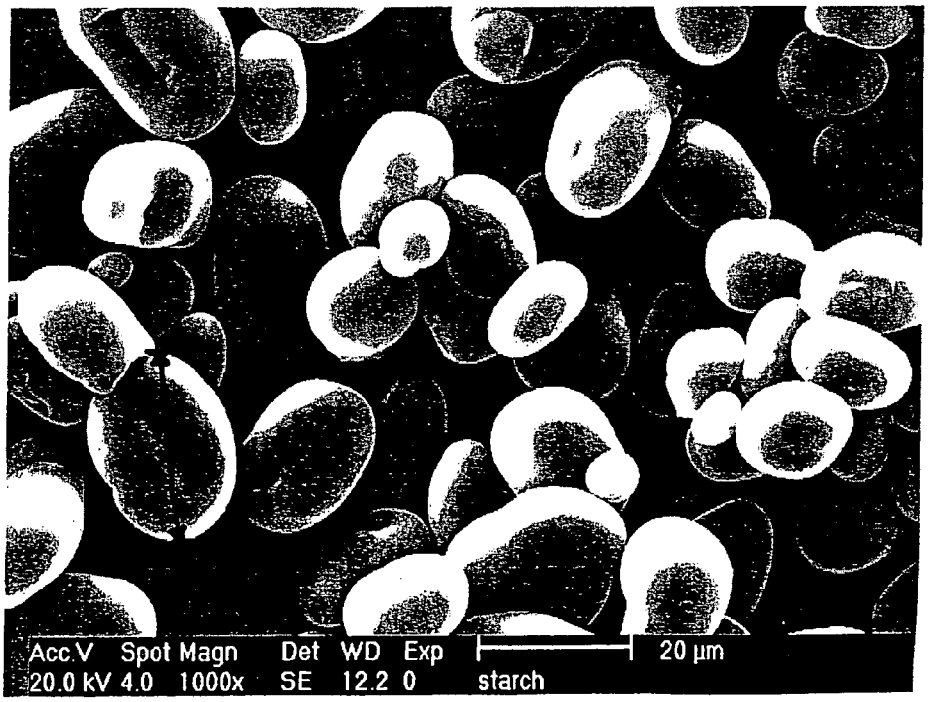
Figure 13A:
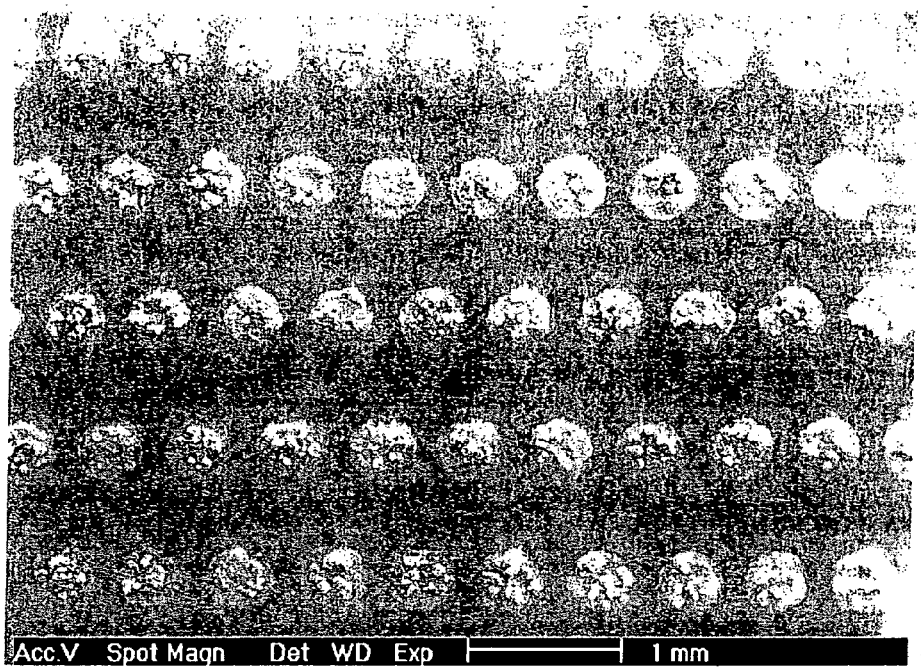
FIGS. 13A–13E show magnified images of the electrode of Example 12.
Figure 13B:
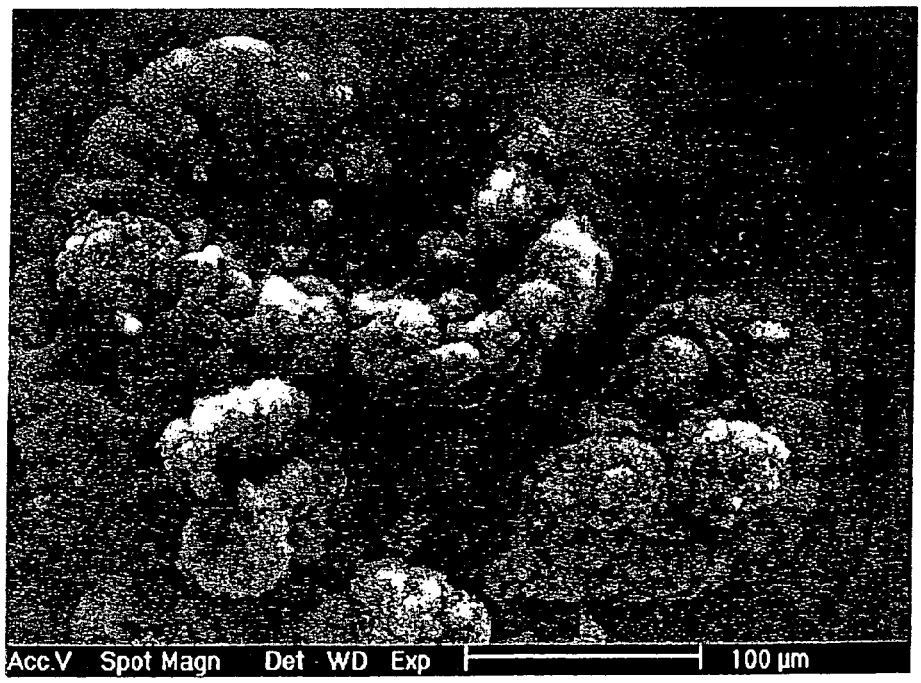
Figure 13C:
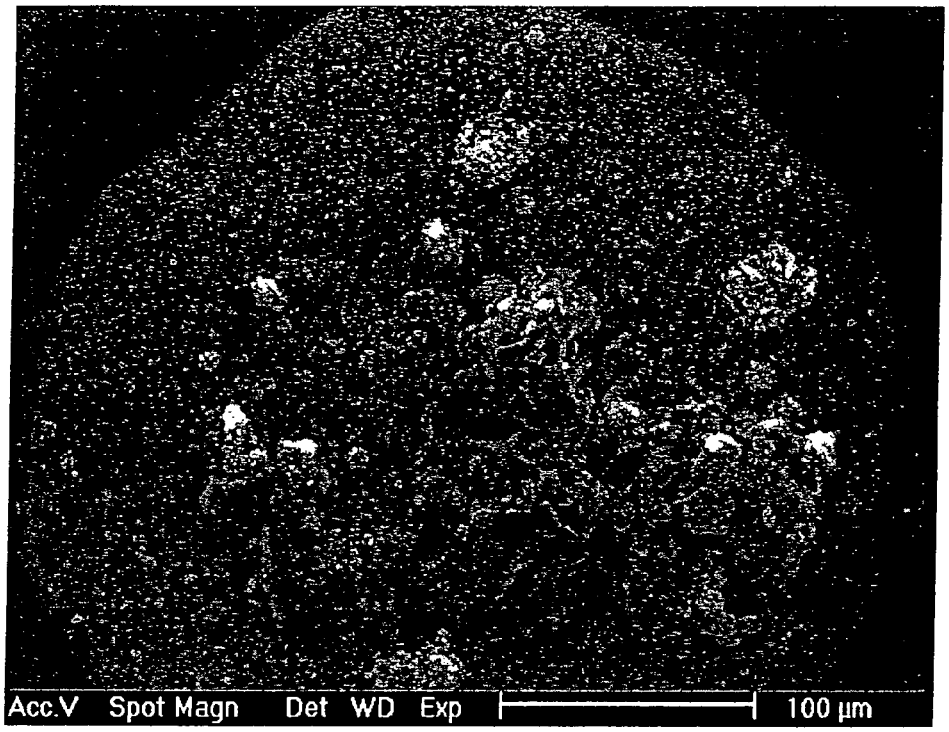
Figure 13D:
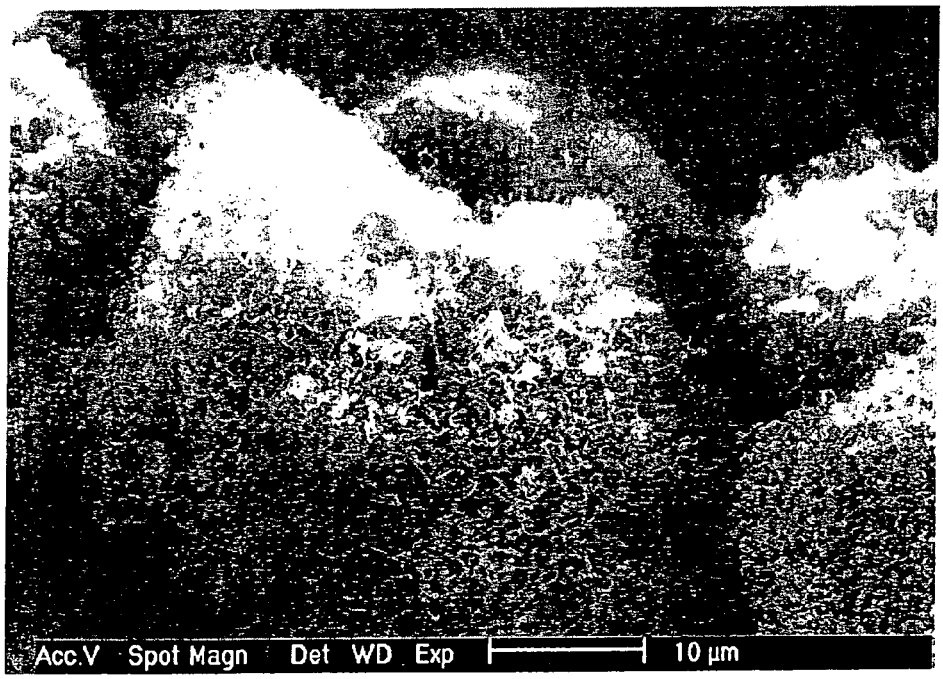
Figure 13E:
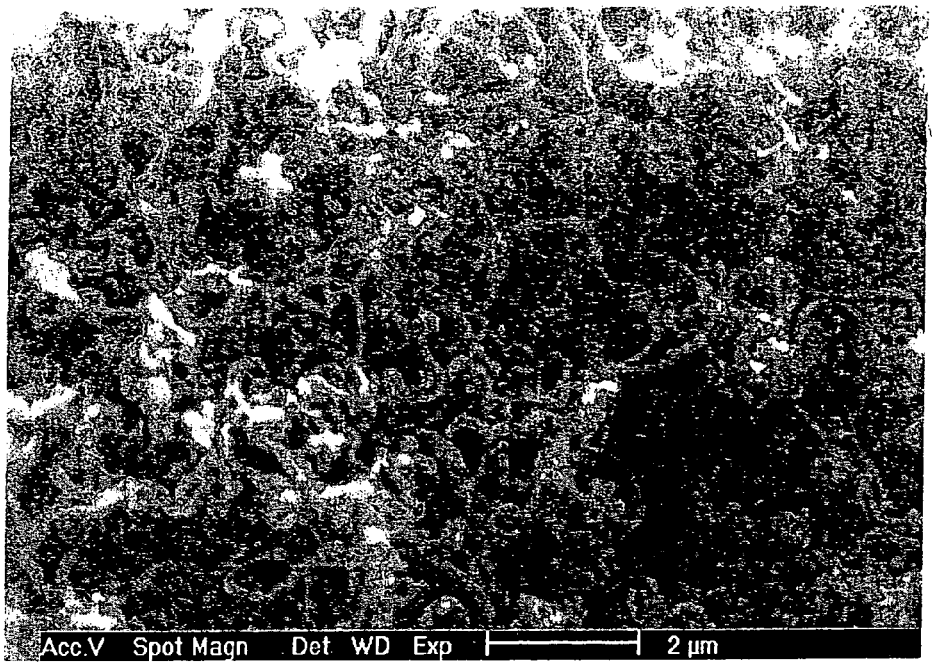
Figure 14A:
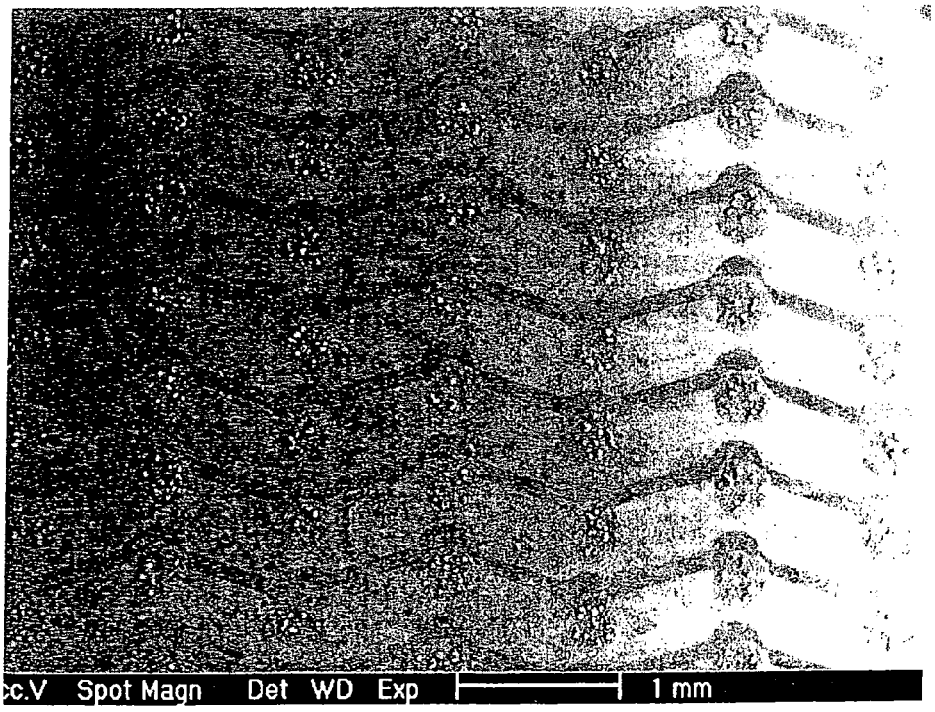
FIGS. 14A–14E show magnified images of the electrode of Example 11A.
Figure 14B:
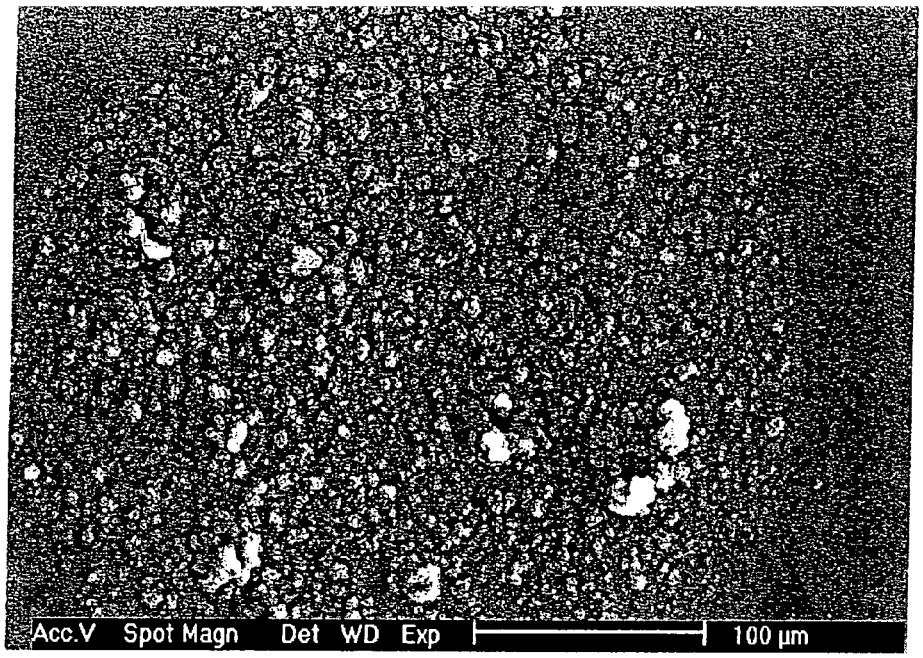
Figure 14C:
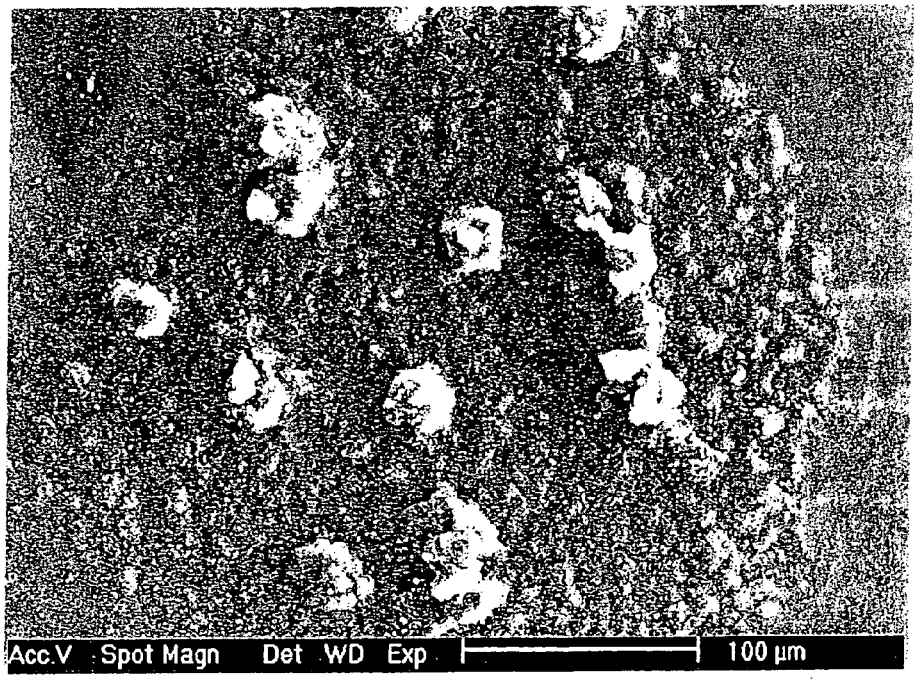
Figure 14D:
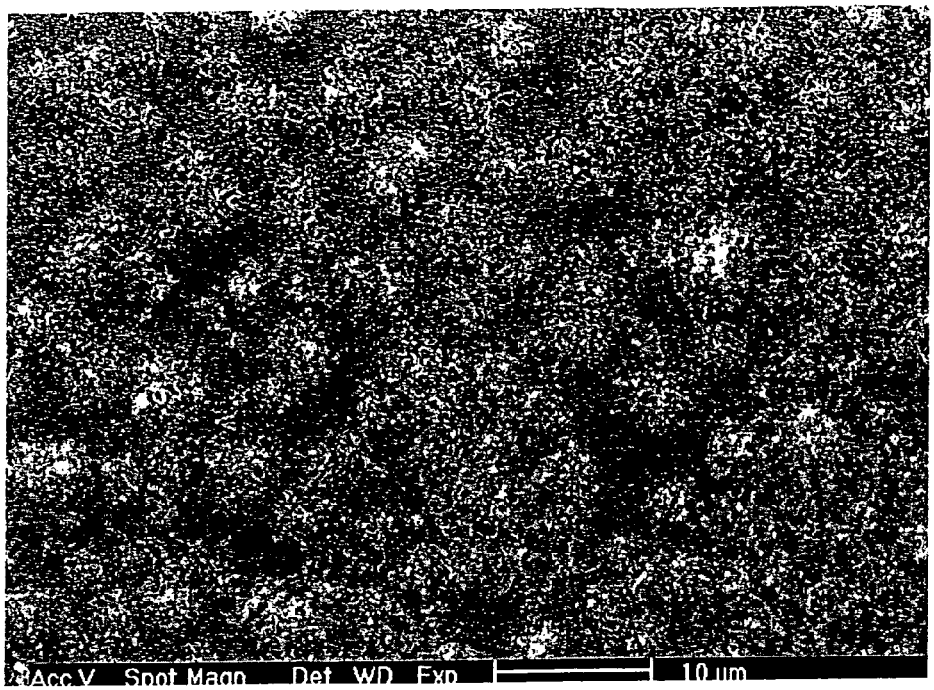
Figure 14E:
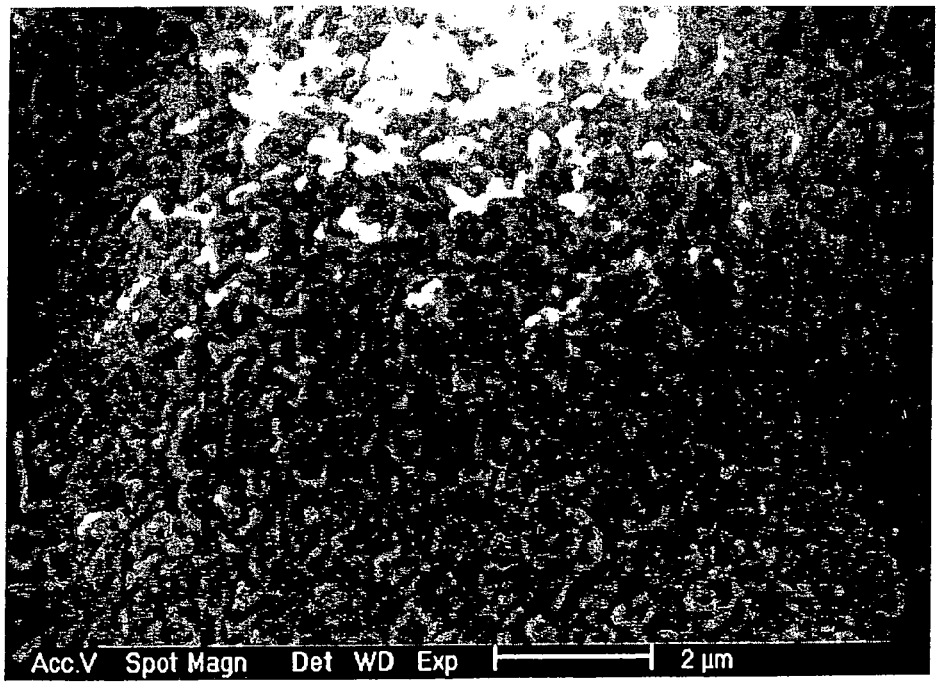
Figure 15A:
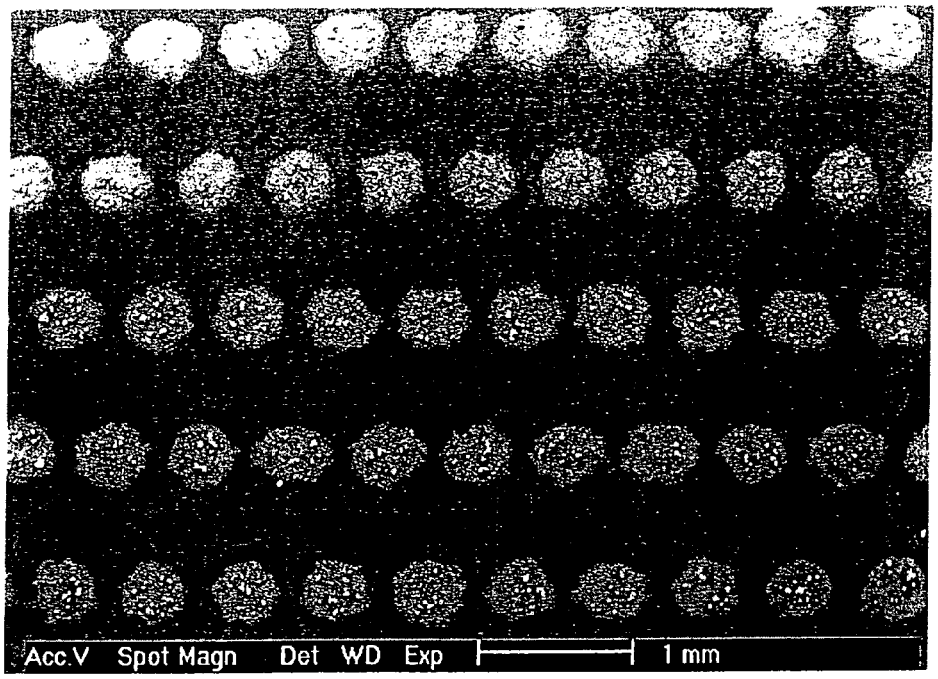
FIGS. 15A–15E show magnified images of the electrode of Example 8.
Figure 15B:
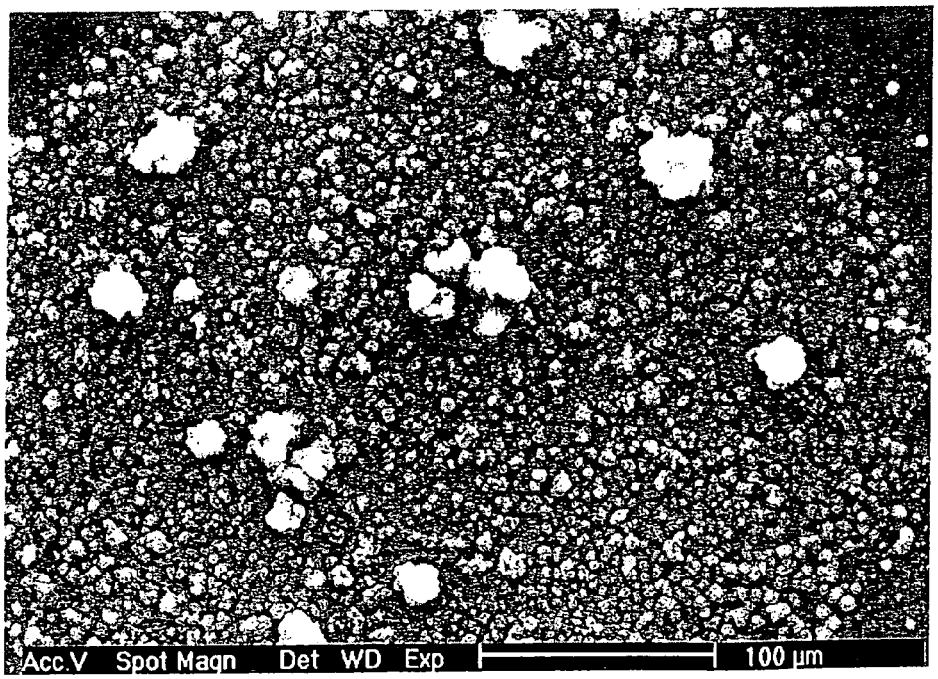
Figure 15C:
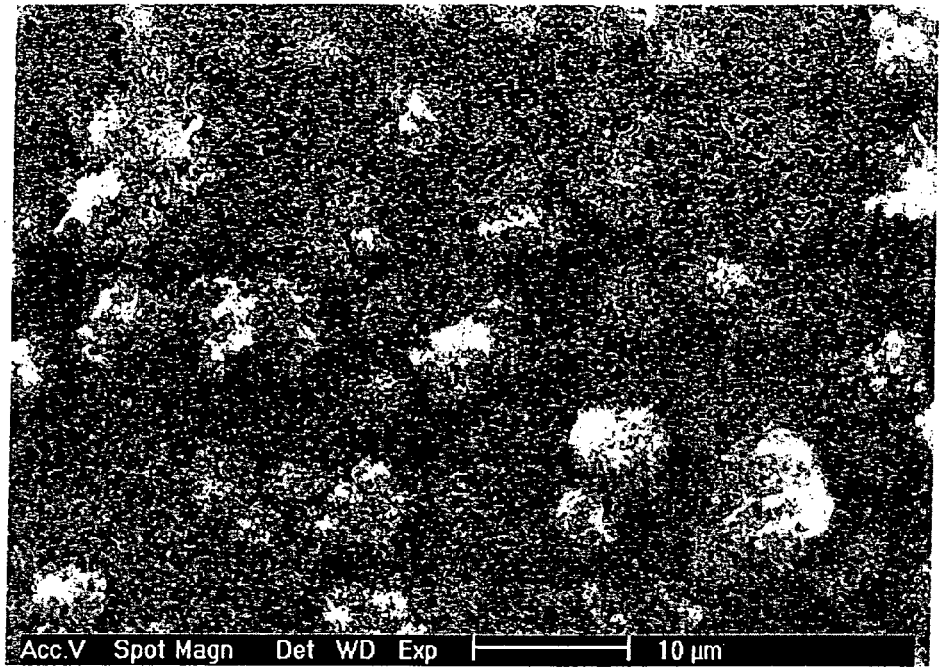
Figure 15D:
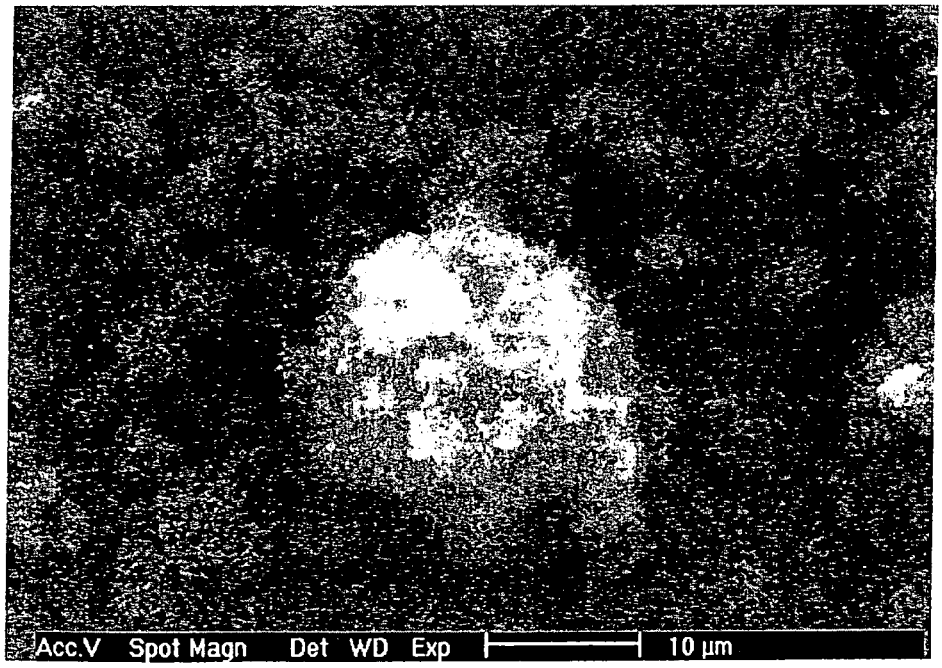
Figure 15E:
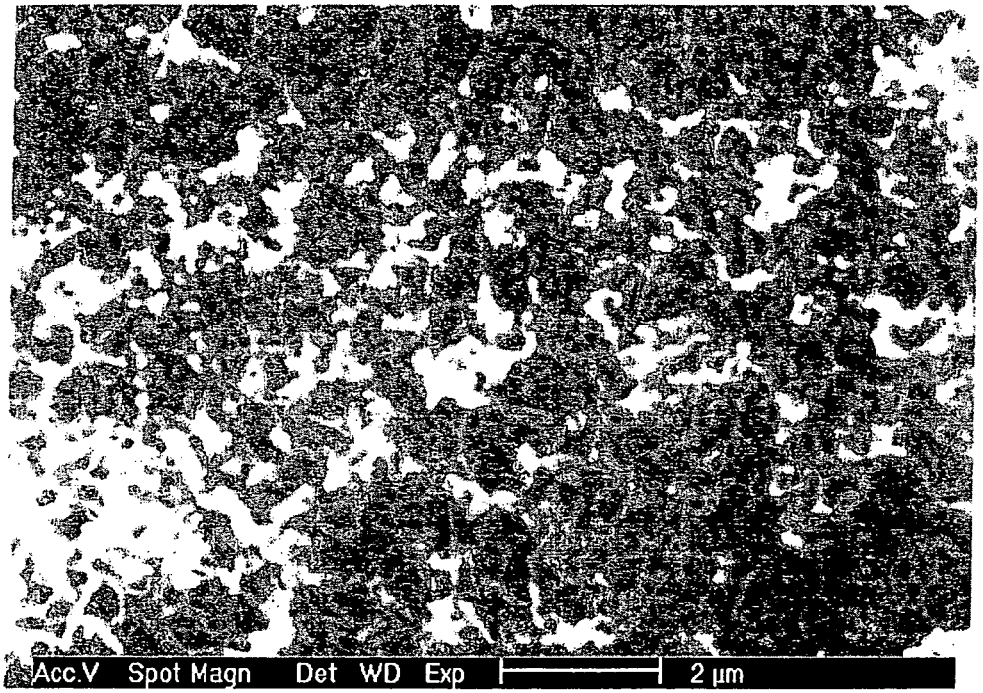

A catalyst paste (D5A) was produced using the same process as the catalyst paste D5 used in Example 2, except 1 wt % of mung bean starch was added to the alcohol catalyst solution prior to mixing the alcohol catalyst solution with the ethyl cellulose and terpineol paste. The starch provided organic particulates as shown in FIGS. 12 and 13 having a mean maximum lineal dimension, e.g. the largest distance between any two points on the surface, in a range from about 5 μm to about 20 μm. A field emission diode was fabricated using the carbon nanofibers grown from this catalyst paste as the cathode, and the entire anode area (34 $cm^2$) was light emitting. A low field strength threshold, 1.5 V/μm, was obtained.

Example 9

In this example, the nickel nitrate of Example 3 was replaced with an iron nitrate. Screen printing produced a desirable uniformity in dispersion of the catalyst on the aluminum surface. The emission characteristics were similar to Example 3, using nickel nitrate alone.

Example 10

A catalyst paste (D9A) was prepared using the same process as Example 6, except that 0.2 wt % iron was dissolved in alcohol before adding 20 vol % of the catalyst solution to the paste. The pixels lacked sufficient adhesion to the aluminum, resulting in detachment under compressed air, as shown in FIG. 2A.

Example 11A

Example 8 was repeated, except that the catalyst paste (D6A) comprised 0.16 wt % iron instead of 0.1 wt % iron and 3 wt % starch rather than 1 wt % starch. Excellent printing characteristics and adhesion were achieved. An area of 4 $cm^2$ was deposited and 50% of the area was emitting. A current density of 2.7 $cm^2$ at electrical field 4.25 V/μm was obtained. The field strength threshold was less than 3.5 V/μm and the maximum current density was the greatest of any of the Examples, as shown in FIG. 11.

Example 12

Example 8 was repeated again, except that 0.08 wt % of nickel, 0.082 wt % of iron and 5 wt % mung bean starch were added directly to the ethyl cellulose/terpineol paste without using ethanol as a solvent. Inhomogeneous growth of irregular topological features are evident in FIGS. 13A–13E.

A field emission device is achieved in some examples having pixels comprised of isolated clusters that adhere to a conductive electrode. The resulting current density of a field emissive device may be greater than 200 $\mu A/cm^2$, and the field strength threshold may be less than 2 V/μm. It is believed that screening effects are reduced by the morphology of the entangled nanofiber clusters and by isolating clusters by a distance greater than the distance that an individual nanofiber can extend, which depends on the morphology and entanglement of the nanofibers in a cluster.

In one embodiment, posttreatment of the fibrous clusters, such as hydrogen plasma treatment, exposure to ultraviolet light, laser ablation treatment and/or ion bombardment, may improve the emission characteristics. It is thought that such conventional treatments increase surface defects of nanofibers, increasing the density of emitters.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electron emitter for use in a field emission device comprising:

a conductive electrode;

a plurality of fibrous clusters; and an adhesion layer adhering the plurality of fibrous clusters to the conductive electrode, wherein the adhesion layer is formed during processing of a catalyst precursor and the composition of the catalyst precursor comprises a catalyst compound, a solvent and a plurality of non-catalytic particles, the composition of the catalyst precursor being selected and processed such that particulates of the catalyst compound agglomerate on the non-catalytic particles and form catalytic particulate clusters adhered to the conductive electrode by the adhesion layer, wherein the plurality of fibrous clusters are formed in situ by catalytic growth from the catalytic particulate clusters such that each of the plurality of fibrous clusters comprises a plurality of nanofibers adhered to the conductive electrode by the adhesion layer, and at least a portion of the plurality of fibrous clusters have a hemispheroidal shape.

2. The emitter of claim 1, wherein the process of catalytic growth and the composition of the catalyst precursor are selected such that the plurality of nanofibers is of carbon nanofibers.

3. The emitter of claim 2, wherein the plurality of nanofibers have outer diameters determined by a chemical vapor deposition process and size of the particulates of the catalyst compound.

4. The emitter of claim 2, wherein the chemical vapor deposition process and size of the particulates of the catalyst compound are selected such that the outer diameters of the carbon nanofibers are no greater than 200 nanometers.

5. The emitter of claim 4, wherein the chemical vapor deposition process and size of the particulates of the catalyst compound are selected such that the outer diameters of the carbon nanofibers are at least 50 nanometers.

6. The emitter of claim 1, wherein the hemispheroidal shape is one of an oblate hemispheroid and a prolate hemispheroid.

7. The emitter of claim 6, wherein the hemispheroidal shape is an oblate hemispheroid.

8. The emitter of claim 2, wherein at least a portion of the carbon nanofibers are comprised of carbon nanotubes.

9. The emitter of claim 8, wherein the carbon nanotubes are multi-walled carbon nanotubes.

10. The emitter of claim 9, wherein the multi-walled carbon nanotubes have an outer cylindrical diameter in a range from 50 nanometers to 200 nanometers.

11. The emitter of claim 1, wherein the length of the plurality of carbon nanofibers is selected such that the hemispheroidal shape is of entangled nanofibers.

12. The emitter of claim 1, wherein each of the plurality of fibrous clusters having hemispheroidal shape is isolated from neighboring fibrous clusters having hemispheroidal shape.

13. The emitter of claim 2, wherein the adhesion layer is formed of one of an intermetallic, a carbide, a nitride and combinations thereof.

14. The emitter of claim 2, wherein the conductive electrode is comprised of aluminum or an aluminum alloy.

15. The emitter of claim 2, wherein at least a portion of the plurality of fibrous clusters have hemispheroidal shapes with a mean major axis dimension and the nanofibers have a mean outer diameter, and the mean major axis dimension is no greater than 1000 times the mean outer diameter.

16. The emitter of claim 2, wherein at least a portion of the plurality of fibrous clusters have hemispheroidal shapes with a mean major axis dimension and the nanofibers have a mean outer diameter, and the major axis dimension is in a range from 50 to 100 times the mean outer diameter.

17. The emitter of claim 1, wherein the non-catalytic particles are of an organic material.

18. The emitter of claim 17, wherein the organic material is a starch.

19. The emitter of claim 18, wherein the starch is a mung starch.

20. The emitter of claim 1, wherein the non-catalytic particles have a mean maximum lineal dimension of at least 5 μm.

21. The emitter of claim 20, wherein the non-catalytic particles have a mean maximum lineal dimension of no greater than 20 μm.

22. The emitter of claim 1, wherein the plurality of fibrous clusters are evenly dispersed.

23. The emitter of claim 22, wherein the plurality of fibrous clusters are uniformly sized.

24. A field emissive device using the emitter of claim 1 as a cathode fixed to a substrate, comprising:

an anode opposite of the cathode; and a spacer, wherein the spacer comprises at least one frame providing a gap that separates the anode and the cathode and provides for a rigid structure when the space between the anode and the cathode is evacuated, and the spacer is capable of being sealed to maintain a vacuum within the field emissive device.

25. The field emissive device of claim 24, wherein the threshold field strength is less than 3.5 volts per micrometer.

26. The field emissive device of claim 24, wherein the threshold field strength is less than 2 volts per micrometer.

27. The field emissive device of claim 24, wherein the maximum current density is at least 900 microamps per square centimeter.

28. The field emissive device of claim 24, wherein the maximum current density is at least 2.7 milliamps per square centimeter.

29. The field emissive device of claim 25, wherein the maximum current density is at least 900 microamps per square centimeter.

30. The field emissive device of claim 26, wherein the maximum current density is at least 2.7 milliamps per square centimeter.

31. A field emission display using emitters according to the emitter of claim 1 as cathodes, the field emission display comprising:

at least one anode opposite of the cathodes; and a spacer, wherein the spacer comprises at least one frame that separates the anodes and the cathodes and provides for a rigid structure when the space between the anodes and the cathodes is evacuated and is capable of being sealed to maintain a vacuum.

32. The field emission display of claim 31, wherein a display area of the field emission display has a diagonal measurement of at least 30 inches.

33. A process for fabricating an electron emitter for use in a field emissive device, comprising:

forming an electrode on a substrate;

preparing a catalyst precursor comprised of a catalyst compound, a binder, a solvent and a plurality of non-catalytic particles such that the non-catalytic particles disperse in the catalyst precursor and the catalyst compound forms particulate clusters on the non-catalytic particles;

depositing the catalytic precursor on the electrode;

drying the catalyst precursor;

heating the electrode in an gaseous atmosphere such that the particulate clusters are oxidized;

reducing the oxidized particulate clusters forming active catalyst particulate clusters adhered to the electrode by an adhesion layer; and growing nanofibers catalytically, such that the nanofibers form hemispheroidal fibrous clusters adhered to the electrode by an adhesion layer.

34. The process of claim 33, wherein the step of growing nanofibers includes selecting a composition of gases and a growing time such that the hemispheroidal fibrous clusters comprise entangled nanotubes.

35. The process of claim 34, wherein the step of growing nanofibers includes selecting the composition of gases and the catalyst compound such that the hemispheroidal fibrous clusters comprise carbon nanofibers.

36. The process of claim 35, further comprising converting the carbon nanofibers to silicon carbide.

37. The process of claim 33, wherein the step of forming an electrode forms a pattern of pixels connected by a wiring pattern.

38. The process of claim 37, wherein the step of forming an electrode further comprises the steps of sputtering a layer of aluminum or aluminum alloy and patterning the layer of aluminum or aluminum alloy by depositing a layer of photoresist, developing the layer of photoresist in a pattern, removing the undeveloped layer of the photoresist, etching the aluminum or aluminum alloy in the area of removed photoresist and exposing a pattern of aluminum or aluminum alloy by removing the remaining photoresist.

39. The process of claim 35, wherein the catalyst compound is a mixture of an iron nitrate and a nickel nitrate.

40. The process of claim 33, wherein the step of growing nanofibers grows nanotubes having an outer mean cylindrical diameter in a range from about 50 nanometers to about 200 nanometers.

41. The process of claim 34, wherein the step of growing nanofibers forms isolated fibrous clusters.

42. The process of claim 37, wherein the step of growing nanofibers forms uniformly sized and evenly dispersed fibrous clusters, whereby, when incorporated into a field emission device, the device appears to the human eye to emit light having a uniform intensity.

43. The process of claim 33, further comprising the step of selecting non-catalytic particles from one of a starch, a polymer, a metal, a ceramic and combinations of these such that the non-catalytic particles form an adhesion layer between the catalyst particulate clusters and the electrode.

44. The process of claim 33, further comprising the step of selecting organic non-catalytic particles of a starch such that an adhesion layer forms between the catalyst particulate clusters and the electrode.

45. The process of claim 44, further comprising the step of selecting an organic binder such that particulates of the catalytic compound are bound to the surface of the non-catalytic particles.

46. The process of claim 33, wherein the step of heating comprises raising the temperature of the catalyst precursor to a temperature in a range from 350° C. to 550° C. in a gaseous feedstock selected from one of air, oxygen and carbon dioxide.

47. The process of claim 33, wherein the step of growing nanofibers comprises catalytic chemical vapor deposition of carbon at a temperature of about 550° C. in a gaseous feedstock and the step of growing nanofibers immediately follows the step of reducing the oxidized particulate clusters.

48. The process of claim 33, wherein the step of growing nanofibers comprises a catalytic chemical vapor deposition of carbon using a gaseous feedstock of acetylene, hydrogen and argon.

49. The process of claim 48, wherein the combined volume percent of acetylene plus hydrogen is greater than the volume percent of argon and the volume percent of hydrogen is greater than the volume percent of acetylene.

50. The process of claim 49, wherein the volume percent of hydrogen is about the same as the volume percent of argon.

51. The process of claim 50, wherein the volume percent of acetylene is about 10 volume percent of the gaseous feedstock.

52. The process of claim 44, wherein the step of selecting non-catalytic particles of a starch includes limiting the size of the non-catalytic particles to particles having a mean maximum lineal dimension in a range from 5 micrometers to 30 micrometers.

53. The process of claim 52, wherein the step of selecting limits the size of the non-catalytic particles to particles having a mean maximum lineal dimension in a range from 5 micrometers to 10 micrometers.

54. The process of claim 52, wherein the standard deviation of the mean maximum lineal dimension is less than 3 μm.

55. A sensor for use in measuring the concentration of volatile compounds and gases, the sensor comprising:

an emitter, the emitter comprising:

a conductive electrode;

a plurality of fibrous clusters;

an adhesion layer adhering the plurality of fibrous clusters to the conductive electrode, wherein the adhesion layer is formed during processing of a catalyst precursor and the composition of the catalyst precursor comprises a catalyst compound, a solvent and a plurality of non-catalytic particles, the composition of the catalyst precursor being selected and processed such that particulates of the catalyst compound agglomerate on the non-catalytic particles and form catalytic particulate clusters adhered to the conductive electrode by the adhesion layer, wherein the plurality of fibrous clusters are formed in situ by catalytic growth from the catalytic particulate clusters such that each of the plurality of fibrous clusters comprises a plurality of nanofibers adhered to the conductive electrode by the adhesion layer, and at least a portion of the plurality of fibrous clusters have a hemispheroidal shape;

an anode electrode; and a housing, the housing being configured to separate the anode and the conductive electrode and allowing at least a portion of the volatile compounds and gases external to the housing to enter the housing at a controlled rate, such that the sensor is capable of detecting the presence of at least one of the at least a portion of the volatile compounds and gases external to the housing by the electron emission characteristics between the anode and the emitter.

56. The sensor of claim 55, wherein the electron emission characteristics of the emitter in operation are compared to the known emission characteristics of the emitter to determine one of a presence and an absence of at least one of the at least a portion of the volatile compounds and gases external to the housing.

* * * * *